US011370652B1

(12) United States Patent
DeMartini

(10) Patent No.: US 11,370,652 B1
(45) Date of Patent: Jun. 28, 2022

(54) METHOD AND SYSTEM FOR BLENDING AND DISPENSING LIQUID CANNABIS

(71) Applicant: Richard James DeMartini, Libertyville, IL (US)

(72) Inventor: Richard James DeMartini, Libertyville, IL (US)

( * ) Notice: Subject to any disclaimer, the term of this patent is extended or adjusted under 35 U.S.C. 154(b) by 237 days.

(21) Appl. No.: 16/520,096

(22) Filed: Jul. 23, 2019

Related U.S. Application Data

(60) Provisional application No. 62/702,426, filed on Jul. 24, 2018.

(51) Int. Cl.

| | |
|---|---|
| ***B67D 7/74*** | (2010.01) |
| ***B67D 7/14*** | (2010.01) |
| ***B67D 7/82*** | (2010.01) |
| ***B67D 7/02*** | (2010.01) |
| ***B67D 7/30*** | (2010.01) |
| ***B67D 7/84*** | (2010.01) |

(52) U.S. Cl.
CPC ..... *B67D 7/743* (2013.01); *B67D 7/0227* (2013.01); *B67D 7/14* (2013.01); *B67D 7/145* (2013.01); *B67D 7/302* (2013.01); *B67D 7/82* (2013.01); *B67D 7/84* (2013.01)

(58) Field of Classification Search
CPC ..... B67D 7/0227; B67D 7/14; B67D 7/145; B67D 7/20; B67D 7/302; B67D 7/743; B67D 7/82; B67D 7/84
See application file for complete search history.

(56) References Cited

U.S. PATENT DOCUMENTS

| | | | | |
|---|---|---|---|---|
| 5,119,973 | A * | 6/1992 | Miller | B67D 7/84 222/144 |
| 5,938,080 | A * | 8/1999 | Haaser | B01F 15/0237 222/144 |
| 7,347,344 | B2 * | 3/2008 | Engels | B01F 13/1058 222/1 |
| 8,201,592 | B2 * | 6/2012 | Van Vreeland | B01F 15/00253 141/94 |
| 10,464,030 | B2 * | 11/2019 | Orsita | A45D 44/005 |
| 10,549,247 | B2 * | 2/2020 | Schwartz | B01F 15/00025 |
| 10,786,793 | B2 * | 9/2020 | Bahabri | B01F 13/1069 |
| 2012/0175383 | A1 * | 7/2012 | Engels | B01F 7/00633 222/135 |
| 2019/0062144 | A1 * | 2/2019 | Greenbaum | B67D 7/74 |

* cited by examiner

*Primary Examiner* — Ryan A Reis
(74) *Attorney, Agent, or Firm* — Charles T. Riggs, Jr.

(57) ABSTRACT

A method and system for blending and dispensing liquid *cannabis* enables dispensaries, pharmacies or other users to fulfill custom *cannabis* blends of THC, CBD terpenes, and the like. The variety of custom *cannabis* blends would accommodate the wide range of formulas needed to satisfy the next stage of the *cannabis* industry. Personalized *cannabis* solutions can be created using the hardware and software of the method and system.

20 Claims, 28 Drawing Sheets

Filter Mixer

Ingredient Library

126

127

Power and Logic Wiring Diagram

METHOD AND SYSTEM FOR BLENDING AND DISPENSING LIQUID CANNABIS

TECHNICAL FIELD

The exemplary teachings herein pertain to methods, systems, components and/or devices for blending and dispensing liquid *cannabis*, and in particular, to methods, systems and devices for a countertop or wall mounted, formula based liquid *cannabis* blending and dispensing system.

BACKGROUND

As the *cannabis* industry has grown, so has the technology supporting it. Scientists have discovered new ways of deconstructing *cannabis* oils through advanced distillation, isolating each of the *cannabis* components to their purest level, for example, THC-CBD-Terpenes, with purity levels close to 99%. The medical market has capitalized on the breakdown and purity levels of *cannabis* oil, striving to create a way to dose formulated solutions for pain relief and other chronic rehabilitation techniques.

Manufacturers and *cannabis* producers have flooded the market with a variety of vape pens, capsules and edibles. Medical pioneers are trying to match DNA type to *cannabis* oil blends for targeted treatment. The common problem in the liquid *cannabis* industry is not only consistency but its limited availability and variety.

Most extraction and distillation facilities that produce pure extracts are forced to reconstruct and pre-package oil blends based on inventory and/or business needs, not science, nor in any way target the individual consumer, which limits the possibility of new discoveries and treatment programs. Dispensaries and pharmacies carry a limited combination of blends and cannot facilitate the medical needs of formula-based treatments, especially on a mass scale. It would be near impossible for disparate extraction and distillation facilities to produce enough formula-based blends to accommodate the variety and distribution requirements of the future *cannabis* market.

This creates a less-than-expected experience for consumers with custom tastes and a problem for medical patients dependent on prescribed component ratios of THC/CBD for treatment. If a patient or consumer needed a certain blend of THC %, CBD % and flavoring, there is no place to acquire custom blends. Therefore, there is a need for a liquid *cannabis* blending and dispensing system that enables dispensaries, pharmacies and/or users to fulfill custom *cannabis* blends. The methods and systems of the present disclosure fulfills this and other needs.

SUMMARY

Disclosed herein is a CPU based, precision liquid *cannabis* blending and dispensing method and system, assembled into a countertop vending unit (hereinafter referred to as a "blending station"). The blending station includes a carousel which enables dispensaries, pharmacies and/or users to stock the blending station carousel with various high quality, individual ingredient extraction and or distillation products and mix them with precision onsite and fulfill custom liquid *cannabis* blends of THC, CBD terpenes, as well as non-*cannabis* liquids such as medium-chain triglycerides (MCT), vegetable glycerin (VG) and any safe natural flavorings. This empowers dispensaries, pharmacies and/or other users with new precision capabilities to produce an endless variety of liquid *cannabis* blends that would accommodate the wide range of custom blended *cannabis* formulas that are needed to satisfy the next stage of the *cannabis* industry for both medical and recreational alike.

The method and system utilizes precision formula based blending and dispensing instruction sets embedded in QR codes provided on formula cards, which are produced automatically through the blending station's associated formula creator software. This ensures exact replication of custom tailored product blends. The blending station formula cards can be reused multiple times with consistency. The formulas are either electronically generated and emailed or otherwise electronically transmitted, or printed if an optional card printer is attached. In a preferred embodiment the customer can request and wait for their order to be blended, similar to waiting for a prescription. Formula cards can be created over the internet at an appropriate web site having the formula creator software, and used at participating dispensaries in different remote locations.

Additional advantages and novel features will be set forth in part in the description which follows, and in part will become apparent to those skilled in the art upon examination of the following and the accompanying drawings or may be learned by production and/or operation of the teachings herein.

BRIEF DESCRIPTION OF THE DRAWINGS

The drawing figures depict one or more implementations in accordance with the present teachings, by way of example only, not by way of limitation. It should be understood that such drawings depict preferred embodiments of the invention and are not to be considered as being limiting in scope with regard to other embodiments which are capable of being contemplating from this disclosure. A clear understanding of the disclosed methods and systems may be had by reference to the appended drawings, wherein like reference numerals refer to the same or similar elements.

DETAILED DESCRIPTION

The following description refers to numerous specific details which are set forth by way of examples to provide a thorough understanding of the relevant method(s) and system(s) disclosed herein. It should be apparent to those skilled in the art that the present disclosure may be practiced without such details. In other instances, well known methods, procedures, components, instruments, implements and/or devices have been described at a relatively high-level, without detail, in order to avoid unnecessarily obscuring aspects of the present disclosure.

Figure 1A:
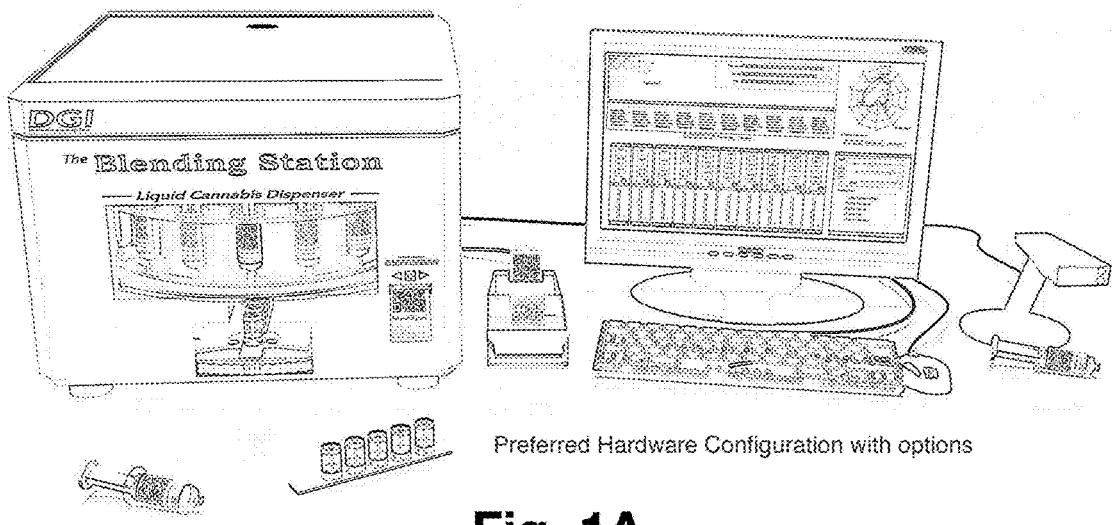
FIG. 1A shows an image of a perspective view illustrating a preferred embodiment of the system hardware configuration of the blending station, a liquid *cannabis* blending and dispensing counter top vending system with optional card printer and hand scanner accessories according to the various embodiments described herein.
Figure 2A:
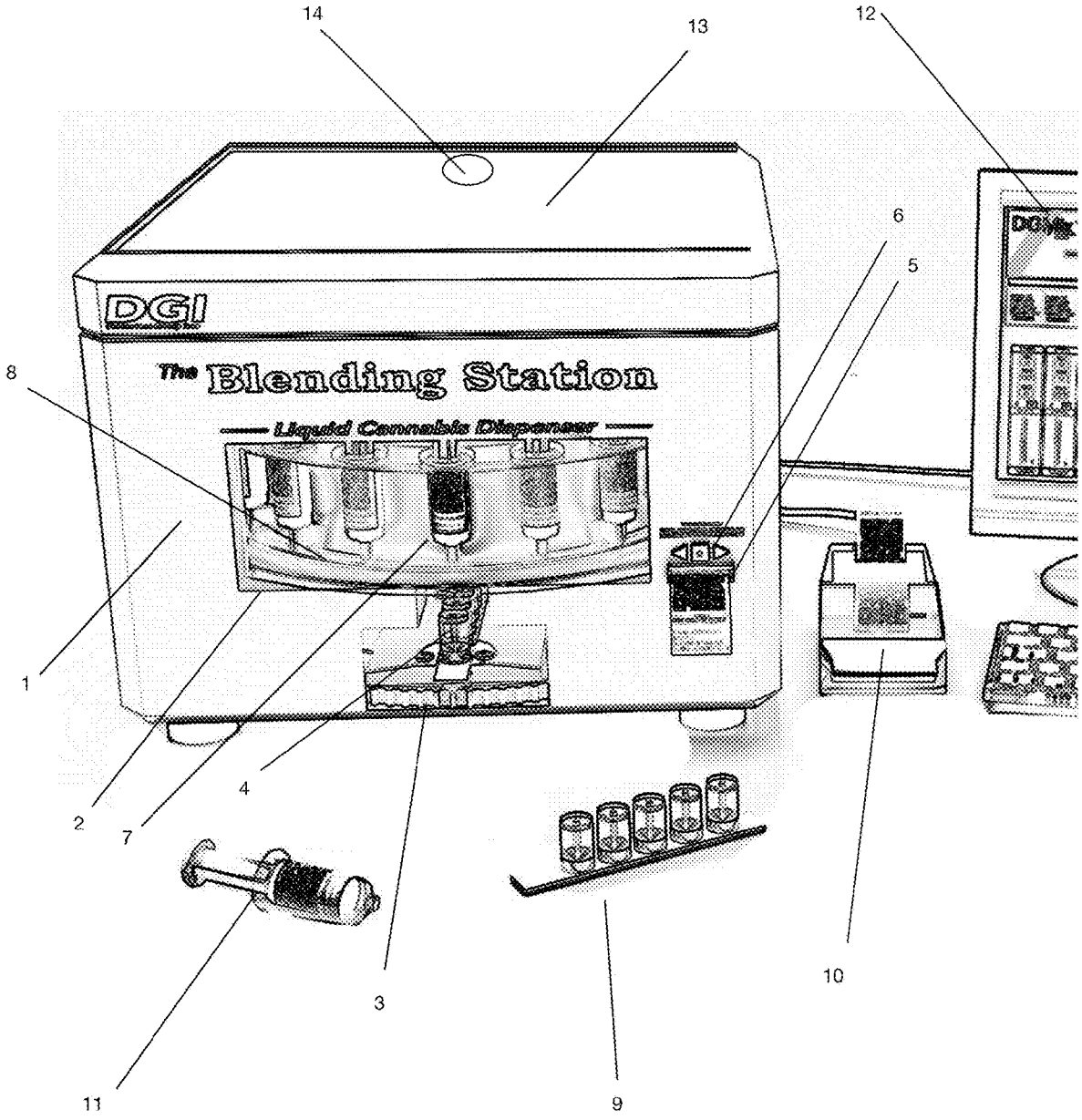
FIG. 2A illustrates an enlarged view of a portion of FIG. 1A.

FIG. 1A shows a perspective view illustrating a preferred embodiment of the blending station system hardware configuration, with optional card printer and hand scanner accessories. FIG. 2A shows an enlargement of a portion of FIG. 1A. FIGS. 1A and 2A both illustrate and describe the basic components of the blending station system. The preferred embodiment of the main housing for the blending and dispensing table top vending cabinet unit 1 is designed to be made out of stainless steel for easy cleaning and durability. The cabinet's preferred measurements would be 20" wide× 20" deep×14" high and constructed with a hinged cover 13 and optional locking system knock out hole 14 for security. In the center of the front panel there is a cut out for an inventory selection display window 2 preferably made of ¼ impact modified acrylic, preferably 12" wide×4" high for security and durability. The beveled display window 2 shows all the available inventory in the carousel 8 as well as the selected inventory container 7 at the current time. The free rotating output base platter 3 which handles the output vessel types, such as but not limited to vape cartridges, dab jars 4 and custom vials, allows the user to manually rotate the output base platter into position, lining up the adjustable mounting brackets that hold the jars 4 or receiver set 9. Once the platter 3 is lined up it locks into place precisely lining up the target vessel below the selected inventory source container 7. Above the output base platter 3, an adjustable mounting system holds the receiving vessel(s) firmly in place during filling process.

Figure 18:
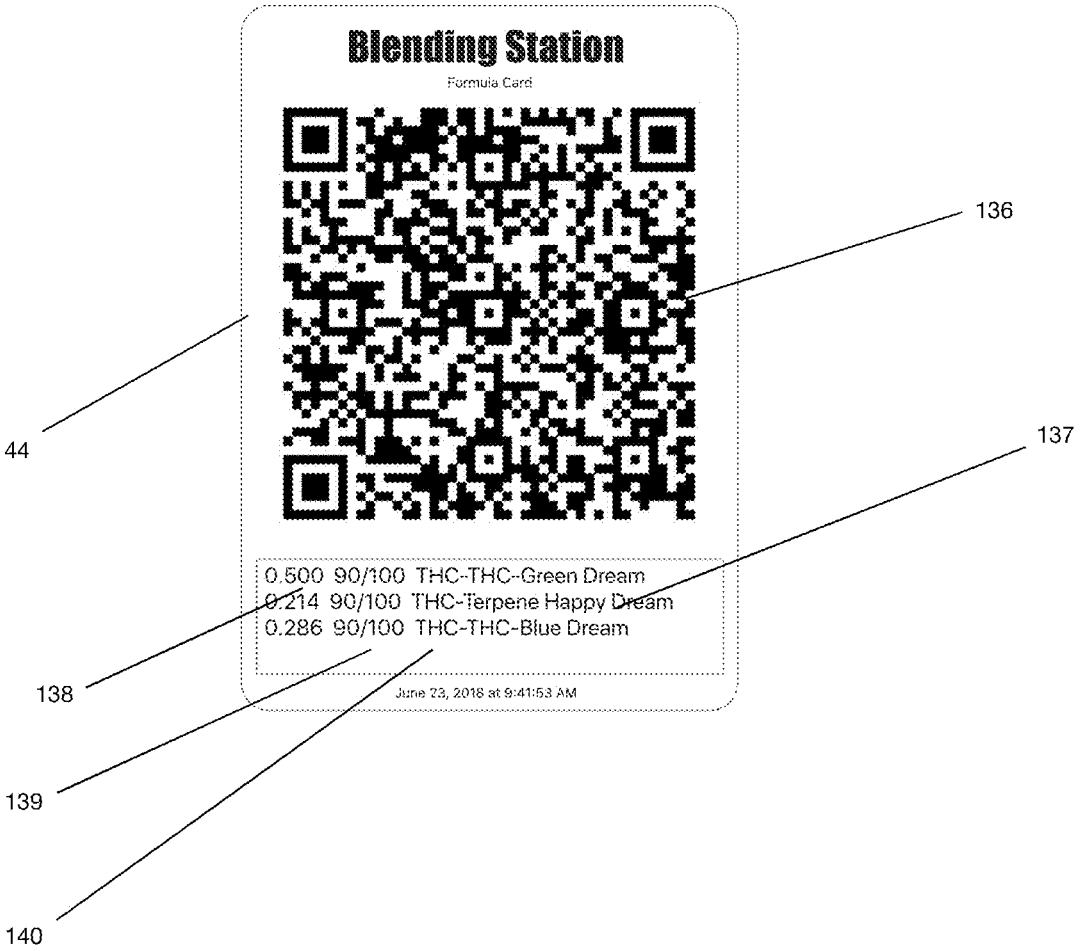
FIG. 18 is an illustration showing the preferred embodiment of a custom formula card according to the various embodiments described herein.

There is also provided a scanning camera 5 for QR-code scanning mounted on the front of the unit for easy card reading and would be used for either scanning QR codes directly off printed formula cards or E-formula cards on a mobile device such as iPhone or android as show in and described with respect to FIG. 18. The system also comes with a port for connecting a hand scanner gun for remote scanning if desired, for example if the scanning camera on the front panel is not practical.

Figure 5:
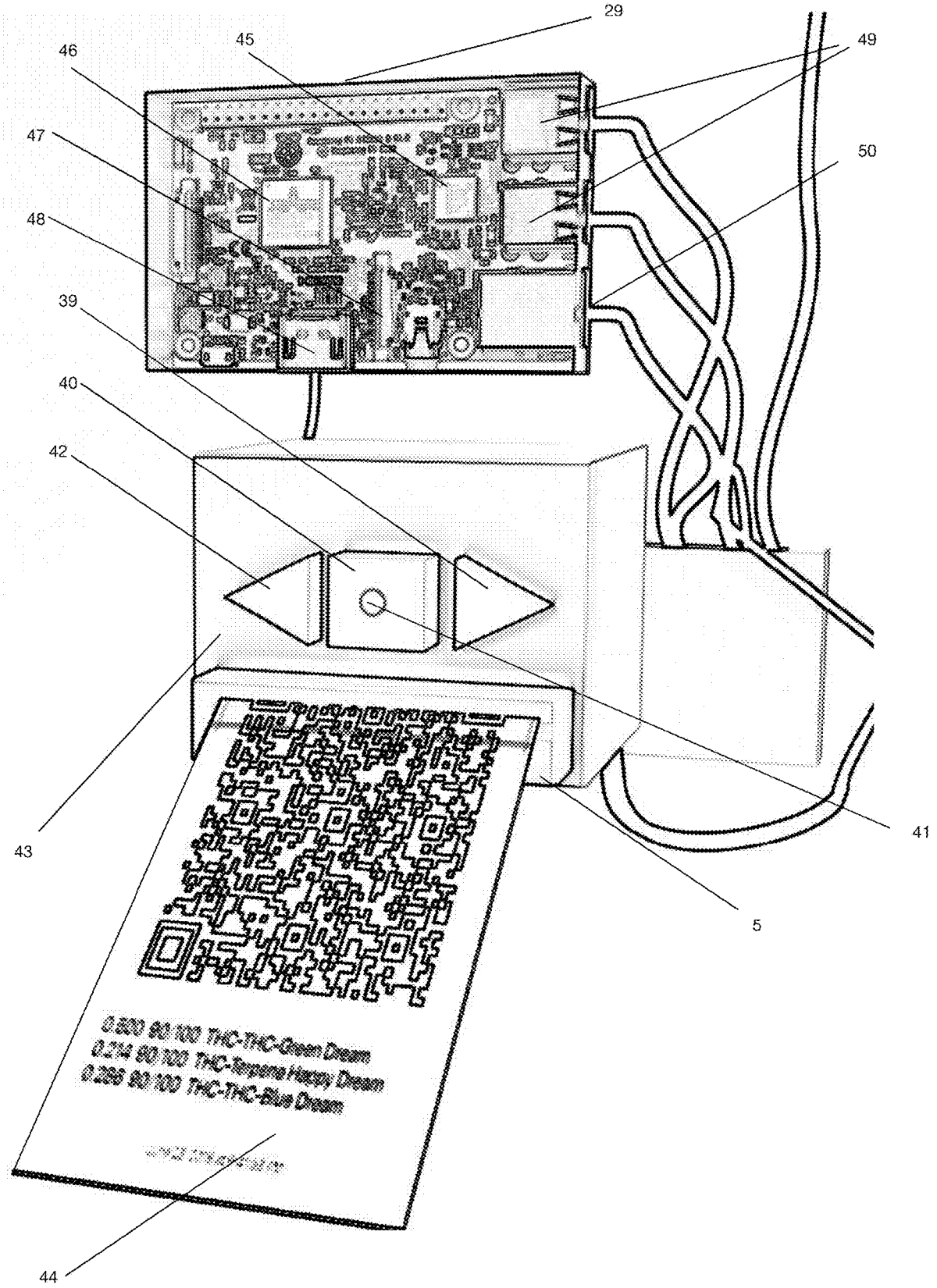
FIG. 5 is a perspective-view diagram illustrating the card scanning unit and manual carousel navigation override buttons, along with a preferred motherboard.

FIGS. 1A and 2A also illustrates manual navigation buttons 6 for carousel drive override, which are typically used to manually rotate the carousel in two different directions. As best seen in FIG. 5, there preferably are three navigation buttons 6, including a left arrow button 42 which increments the carousel left and a right arrow button 39 which increments the carousel to the right. There is also a status button 40, preferably between the left and right arrow buttons. The status button 40 informs the user when the carousel is lined up properly and ready for filling, as described in more detail with respect to FIG. 5.

The blending station software application 12 can also be used to directly navigate the carousel and engage filling mechanism, by making the appropriate selection on the graphic user interface display via a keyboard and/or mouse. Spare thirty milliliter replacement syringes 11 can replace empty syringes in the carousel 8. Multipack strip receiver sets 9 can be inserted into the output base platter 3 for filling. The system may also include an optional USB card printer 10 such as but not limited to DYMO label writer.

In a preferred embodiment, the hardware platform includes a CPU, persistent storage, volatile storage, input device, output device and a network interface. A specific example of a suitable hardware platform would be a Raspberry PI running Ubuntu OS, but it is to be understood that the teachings herein can be modified for other presently known or future hardware platforms.

A monitor is shown displaying the software application 12 and is connected by an HDMI cable, or other suitable connector, allowing most industry standard monitors to plug directly into the HDMI port on the back of the blending station unit so long as the monitor has an HDMI connection. A keyboard and mouse are also shown and are connected via one of the USB ports on the back of the blending station unit, which can be any industry standard USB keyboard type and mouse type. Alternative, the keyboard and mouse could be a wireless keyboard and mouse.

The USB hand scanner is also optional and would be used for either scanning QR codes directly off printed formula cards or E-formula cards on mobile device such as iPhone or android. The QR code scanning would bypass the printed formula card, but offer the same information. If the optional printer is connected, formula cards can be printed to hard copy which can be used multiple times with the same functionality as the E-formula code that would be emailed to user. Standard thirty milliliter syringe casings are used for inventory syringe containers. The illustration also shows replacement inventory syringe container 11 and multi-pack vapor cartridge and or dab jar replacement mounting strip 9.

Figure 1B:
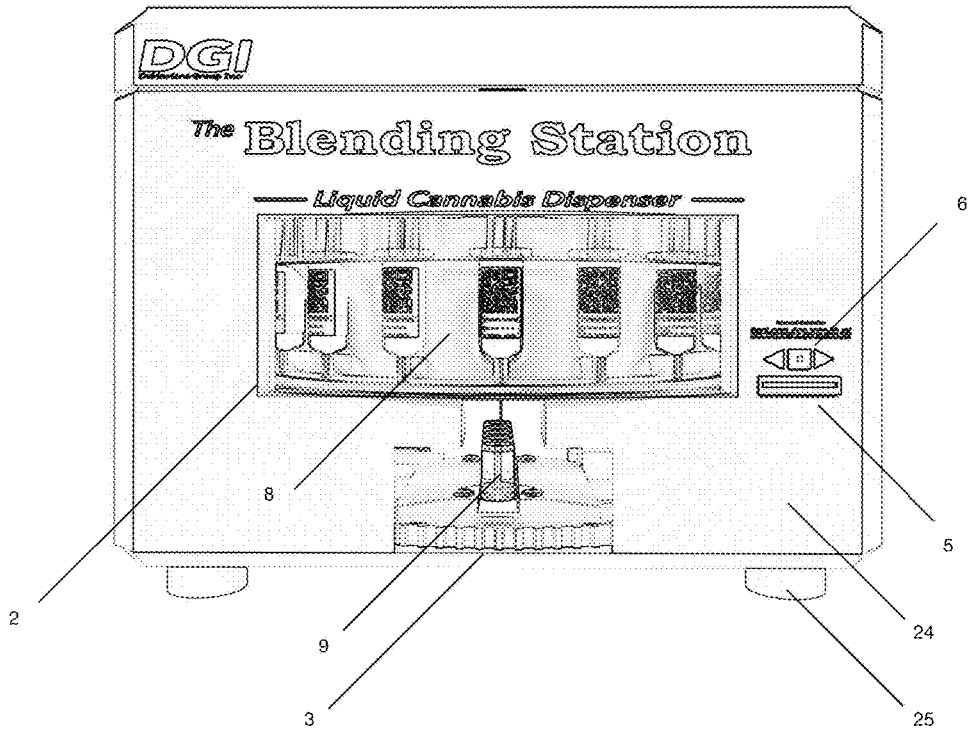
FIG. 1B shows a front view illustrating a preferred embodiment of the blending station according to the various embodiments described herein.

FIG. 1B shows a front view of the blending station, showing a standalone liquid *cannabis* blending and dispensing counter top vending unit 1, with logo and decal placement, as well as the scanning system 5 and manual controls 6 location. This front view also shows the output base platter 3 holding the requested receptacle types such as but not limited to vape cartridges, dab jars 4, or custom vials of various sizes.

As can be seen in FIG. 1B, the inventory display window 2 shows inventory carousel 8. Also seen are the scanning head 5, the manual override carousel drive buttons 6, the base output platter 3 with sample cartridges, and the outer metal housing 24 and rubber feet 25.

Figure 2B:
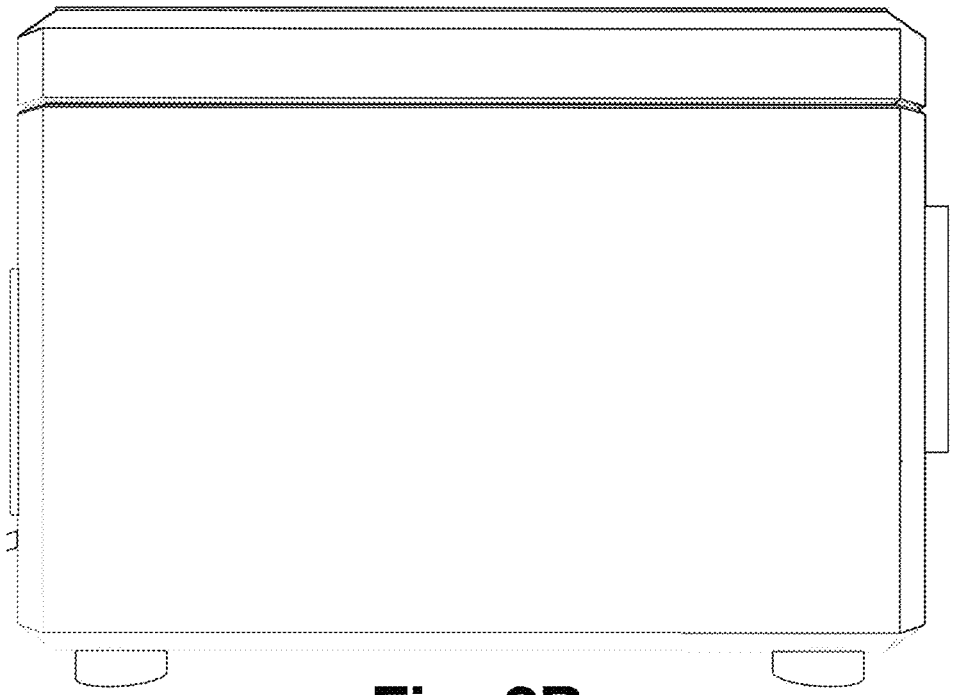
FIG. 2B is a side view of the blending station of FIG. 1B depicting the outer housing according to the various embodiments described herein.

FIGS. 1B and 2B are front and side-view diagrams, respectively, depicting the blending station cabinet design and shape, showing positioning of the inventory display window 2 in the center of the front panel, as well as inventory carousel 8, rubber feet 25, the scanning head 5, manual override carousel drive buttons 6, and the base output platter 3 with sample cartridges. In one embodiment, the cabinets measurements could be up to 22" wide×22" deep×22" high and constructed with a hinged cover 13 and optional locking system knock out hole 14 for security. The display window 2 could be up to a 16" wide×4" high cut out for the inventory display window.

Figure 3A:
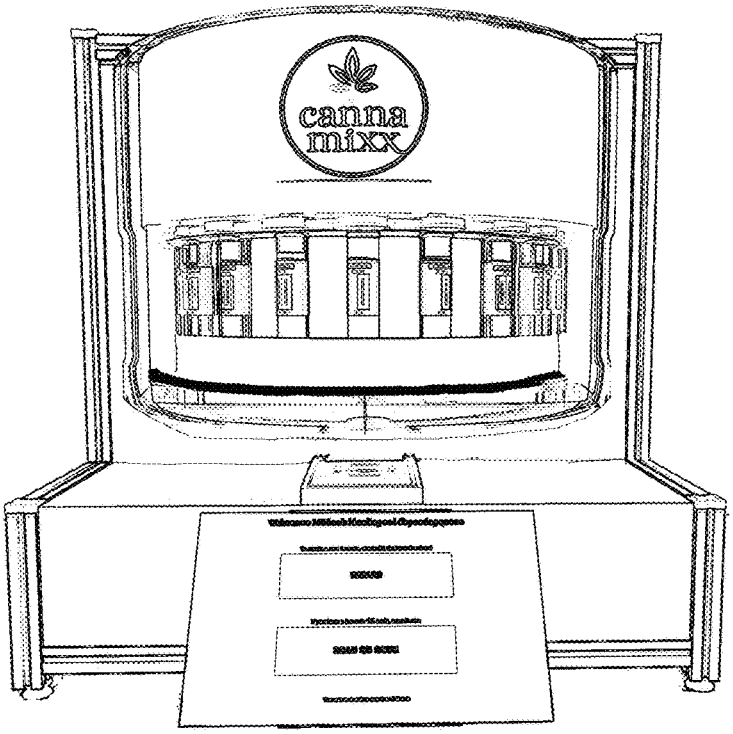
FIG. 3A shows a front perspective view illustrating an alternate embodiment of the blending station according to the various embodiments described herein.
Figure 3B:
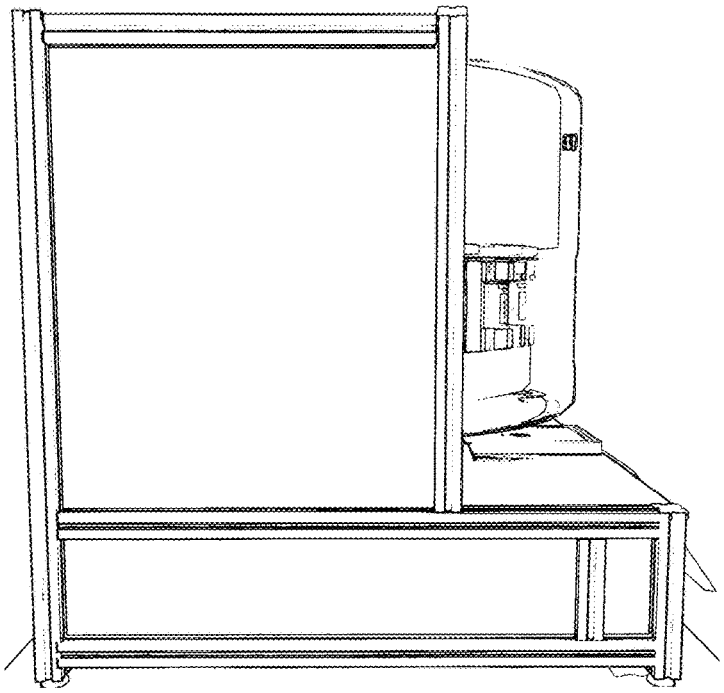
FIG. 3B shows a side view illustrating the alternate embodiment of FIG. 3A.
Figure 3C:
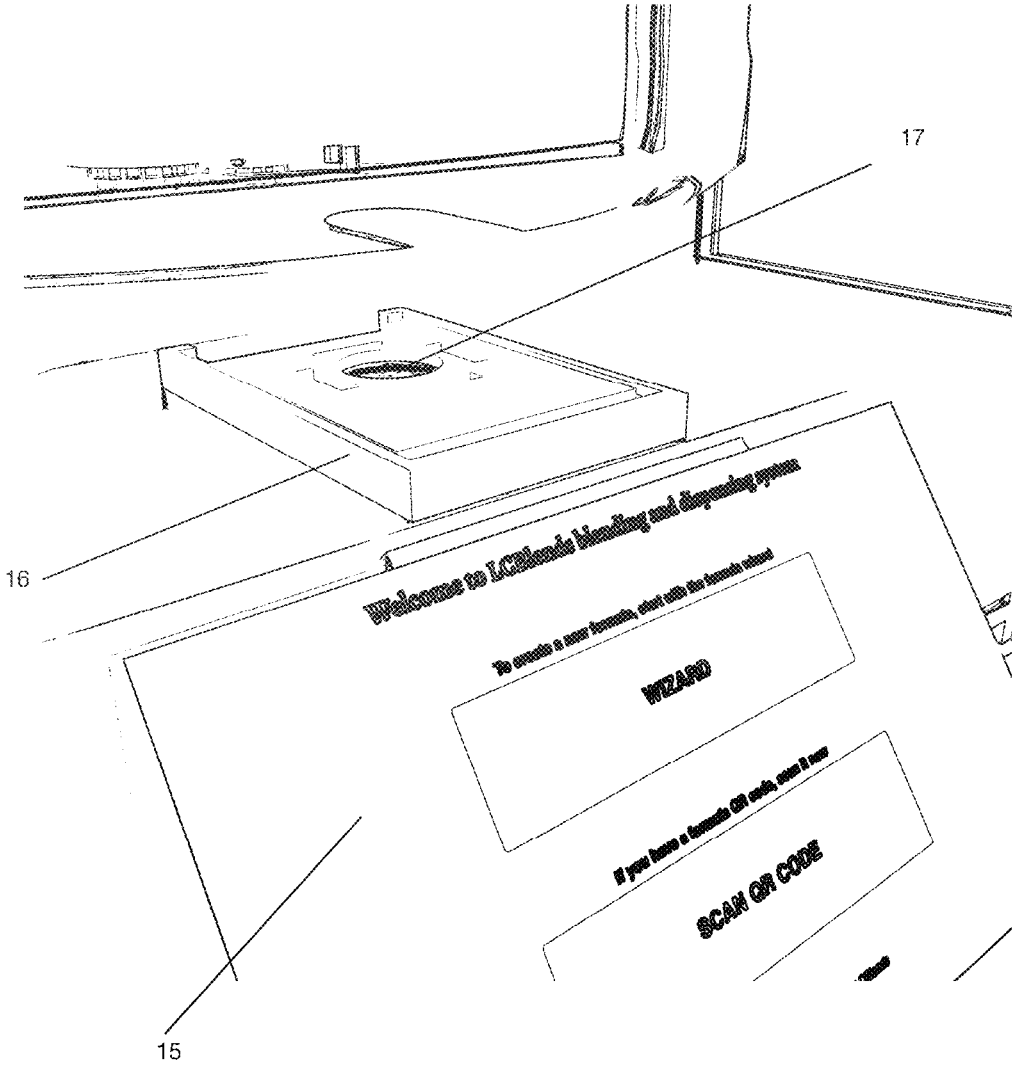
FIG. 3C illustrates an enlarged perspective view of a portion of FIG. 3A.

FIG. 3A shows a front view illustrating an alternate embodiment of the blending station frame and casing, comprising a liquid *cannabis* blending and dispensing counter top vending system with mounted touch screen monitor and integrated scale, as described in more detail with respect to FIG. 3C. FIG. 3B shows a side view illustrating this alternate embodiment of the blending station.

FIG. 3C shows a closeup perspective view illustrating this alternate embodiment of the blending station frame and casing, having mounted hi resolution touch screen monitor 15 and integrated high precision 0.001 gram scale 17 with scale sensitivity windscreen casing or windscreen housing 16 for stability without a closed cabinet. The use of a scale in series with the dispensing pulse shown in and describe with respect to FIG. 20 allows for precision dispensing measurement when dispensing specific formulas.

Figure 4:
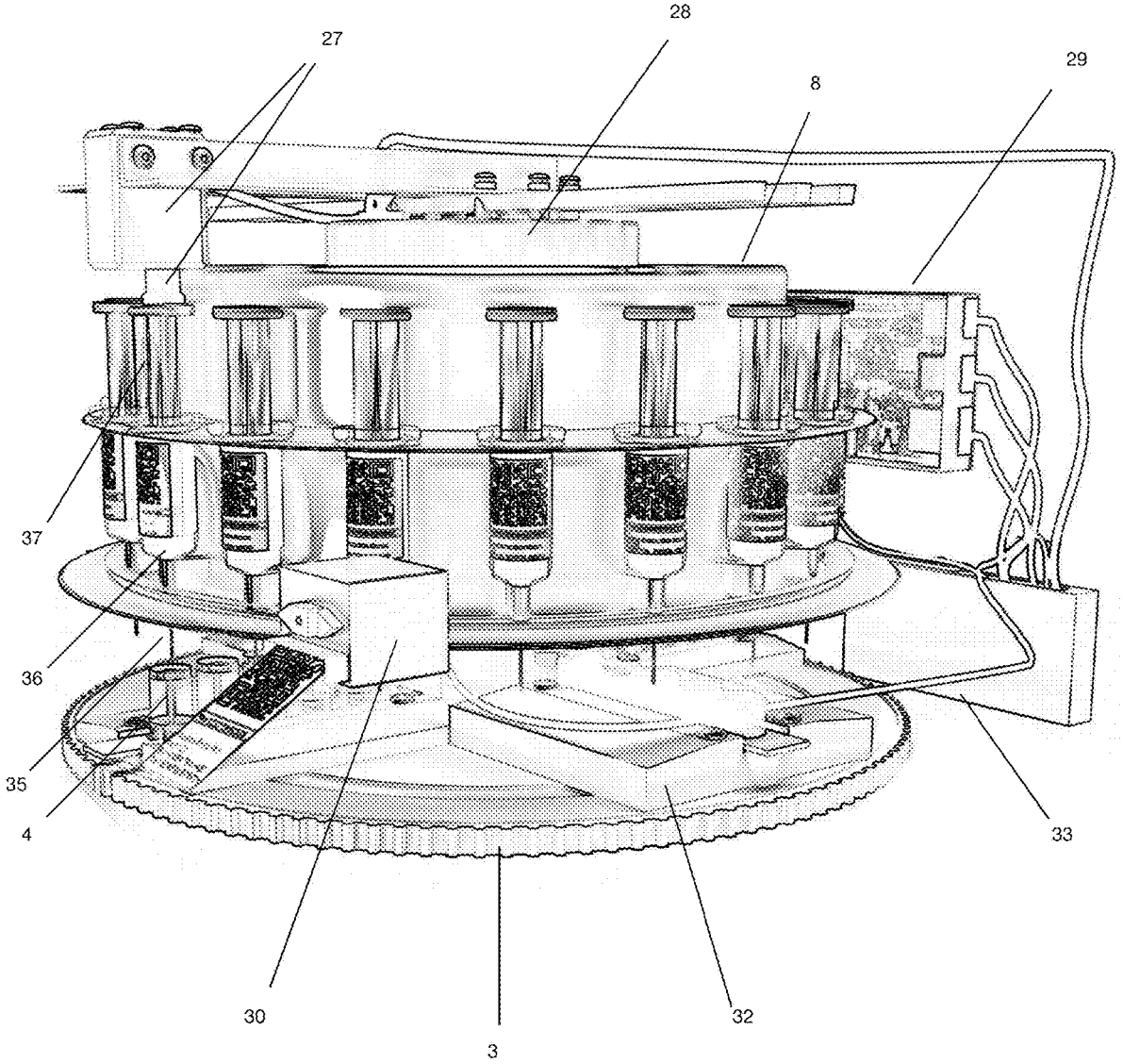
FIG. 4 is a perspective-cut away view diagram depicting the interior mechanical components of the blending station according to the various embodiments described herein.

FIG. 4 is a perspective-cut away view diagram depicting the interior mechanical components of the blending station, including but not limited to inventory carousel 8, plunger motor assembly 27, upper drive shaft cap 28, metal mother board CPU housing 29, scanning and override button housing 30, base output platter 3 with adjustable jar mounts 32, and metal junction box 33 for wiring distribution.

The carousel 8 is held in place by the upper drive shaft cap 28. The carousel 8 which holds the inventory cartridges 36, programmatically or manually rotates allowing the system to select which inventory cartridge 36 to be used. Once the desired cartridge 36 is selected and in position, the plunger motor assembly 27, comprising a plunger stepper motor and a stepper plunger, depresses the cartridge plunger 37, and thereby dispensing the ingredient out of the disposable syringe tip 35 and into the receiving unit such as dab jar 4, below the syringe tip 35. Based on the individual ingredient ratio of the formula, the exact amount of liquid is dispensed. A flow sensor solenoid (shown and described with respect to FIGS. 7A-7D) measures the flow of liquid and tells the CPU to instruct the plunger stepper motor to start and stop thereby dispensing the exact amount of liquid.

This process repeats for each of the ingredients in the formula instruction set provided on the formula card as show in and described with respect to FIG. 18. The information stored in the QR Code, a code capable of coding 1,167 numerals with its maximum version being 14 (73×73 modules), and which contains information such as but not limited to formula ratio, description, potency quantity and ingredient profile.

FIG. 4 also shows base output platter 3 with adjustable receiving vessel mounts 32. The preferred embodiment of system comes with a metal mother board CPU housing 29 for the preferred mother board CPU, and metal junction box 33 with wiring harness connection ports.

The scanning camera and override button housing 30 is connected directly to the CPU housing 29 and sends it scanned formula information and carousel position to process the formula dispensing with total precision. This is best shown in FIG. 5 which is a perspective-view diagram illustrating the card scanning unit 5 and motherboard 29 having port 48 for a hand scanner gun. The card scanning unit 5 has manual carousel navigation override buttons 39, 40, 42, with status LED 41 on status button 40, which are embodied in mounting case 43. Left arrow button 42 increments the carousel left and right arrow button 39 increments the carousel to the right. The status button 40 is also a start/stop filling button. The status LED 41 informs the user when the carousel is lined up properly and ready for filling which enables the start stop switch (in manual operation mode). Formula QR code card 44 is a sample formula card only and shows positioning. The preferred motherboard 29 includes a CPU 46, persistent storage 45, volatile storage 47, at least one input device or port 48, one or more output devices or ports 49 (two shown) and a network interface port 50.

Figure 6:
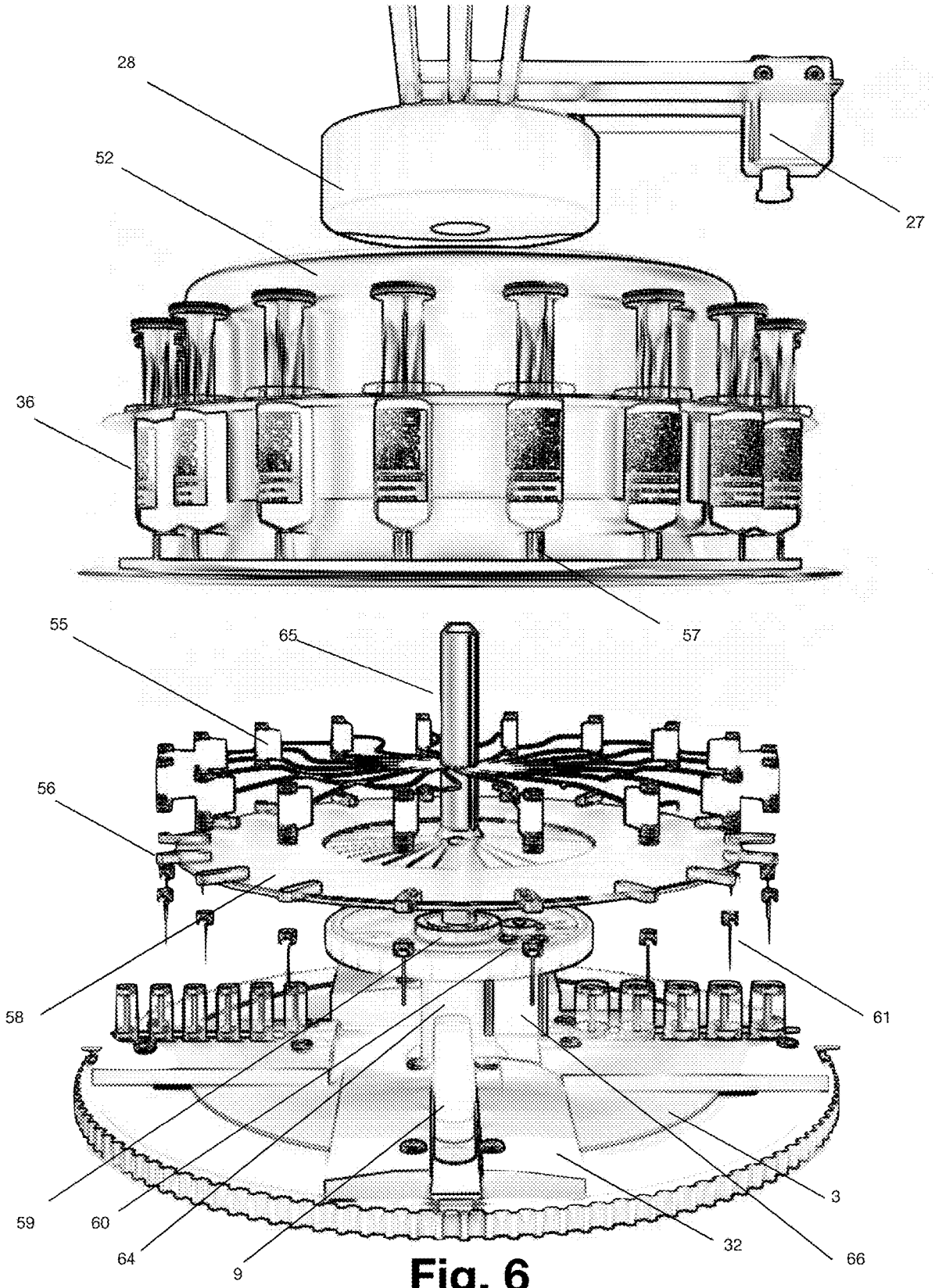
FIG. 6 is a perspective-exploded view diagram illustrating the interior mechanical components of the blending station according to the various embodiments described herein.

To best show the interior mechanical components of the blending station and the preferred method in which they work and fit together, FIG. 6 shows an exploded perspective view diagram illustrating a preferred embodiment of the method and system disclosed herein. The output base platter 3 which holds the receiving vessels 9 and mounting brackets 32, rotates freely on center chases mount spindle 64 and snap locks into a lock mode when not being rotated. The upper portion of the chassis mount spindle houses the drive gears 59, 60 (best seen in FIGS. 12A and 12B) for the carousel drive shaft 65. Gear ratios vary between 3×1 to 6×1 and based on formula control data sent to the carousel stepper motor 66 (best seen in FIGS. 12A and 12B) which directly drives the smaller master drive gear 60 with the function of driving the larger carousel shaft gear 59 which in turn rotates the carousel drive shaft 65 and carousel base plate 58 (also seen in FIGS. 12A and 12B) to the desired index position for that ingredient listed in the formula blend. This accurately lines up the desired inventory syringe cartridge 36 directly positioned over the receiving unit 9 below.

Figure 12A:
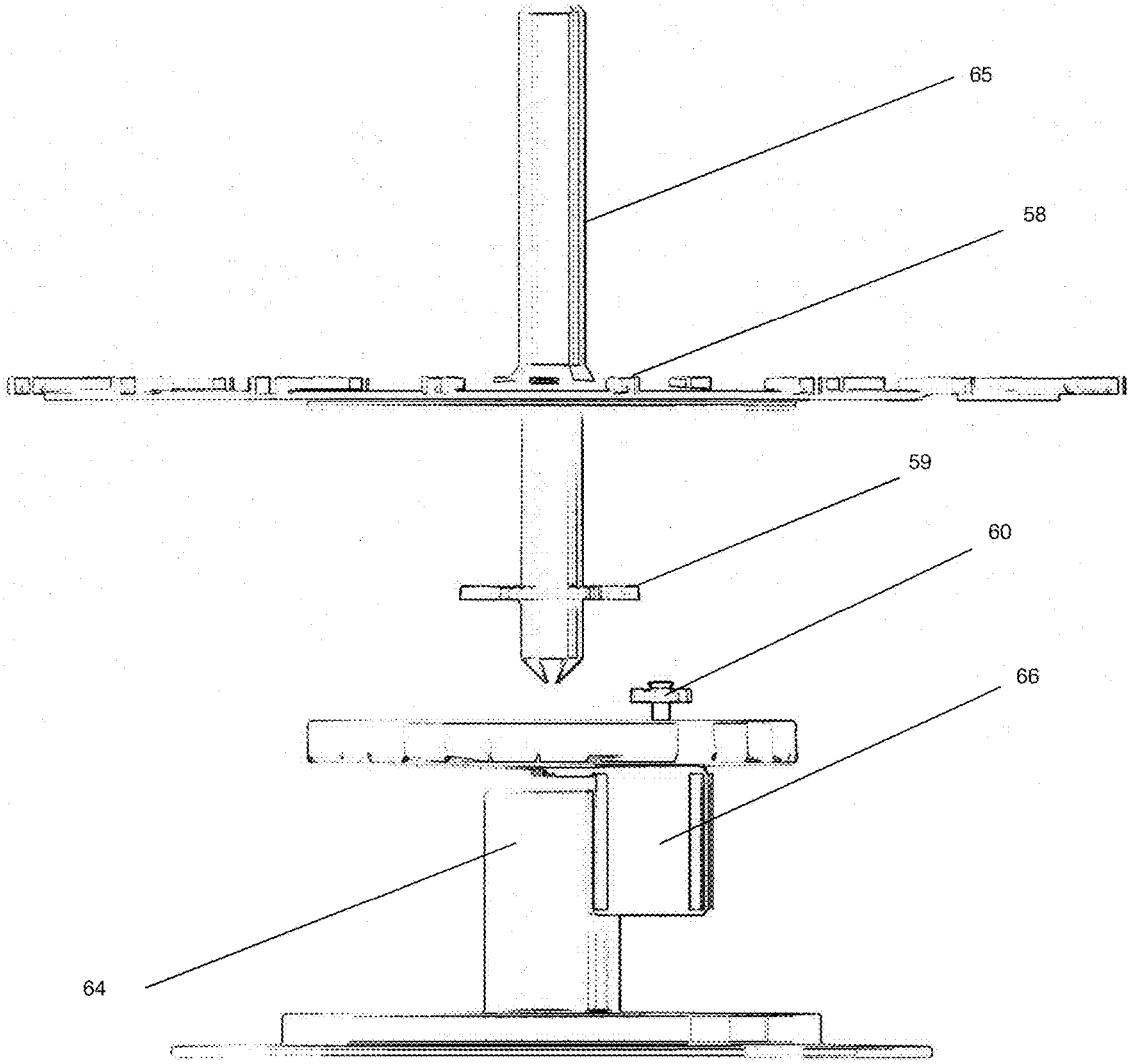
FIG. 12A is an exploded side-view diagram showing a preferred embodiment of the carousel drive shaft and slave gear assembly and carousel stepper motor with drive gear and base mount according to the various embodiments described herein.
Figure 12B:
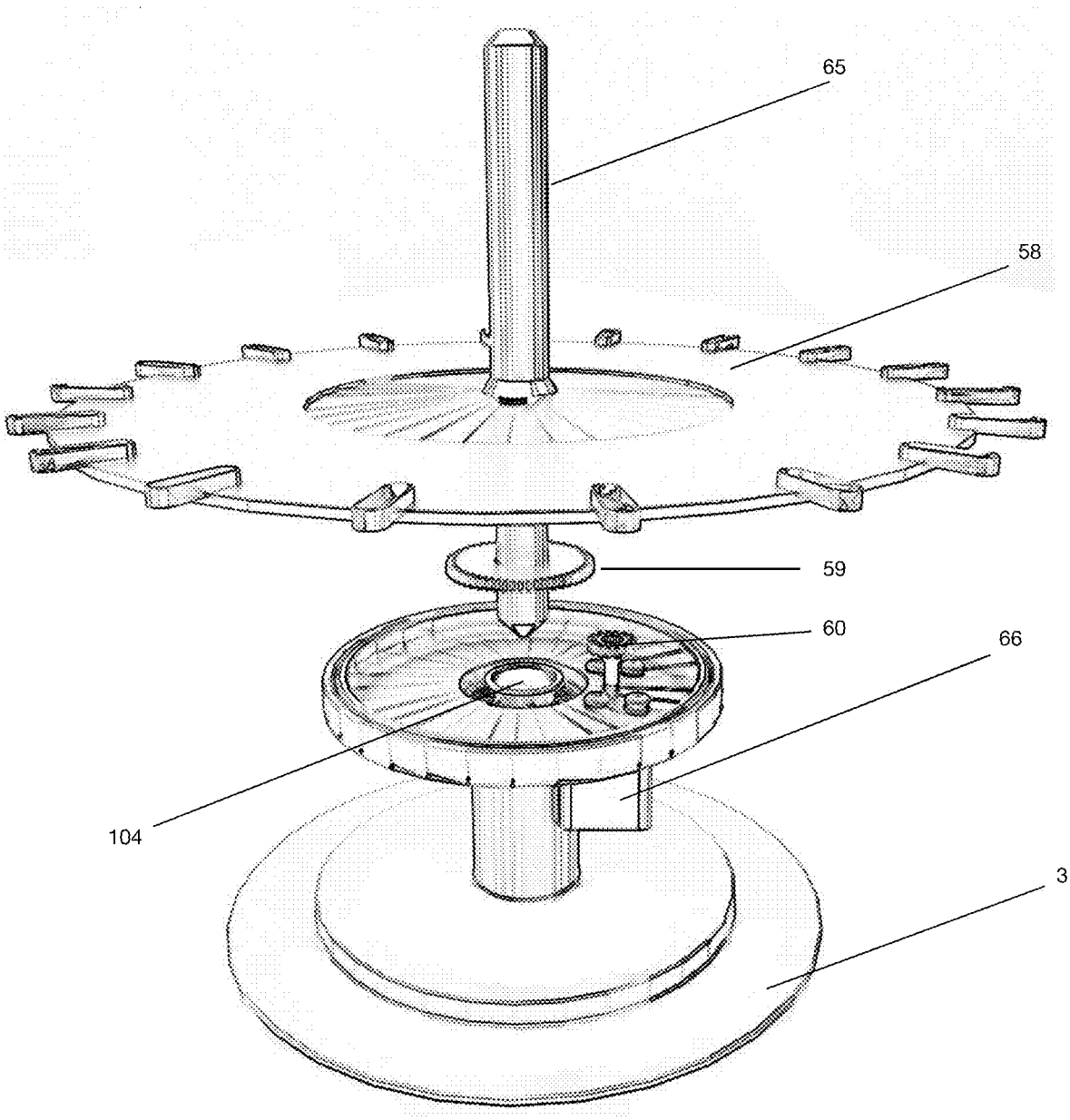
FIG. 12B is a perspective-exploded view diagram of FIG. 12A.

The carousel drive shaft 65 fits down into the chassis base spindle female bushing 104 as illustrated in FIG. 12B. Mounted on the carousel drive shaft 65 is the carousel base plate 58 used to mount the heating and flow sensor solenoids 55 also shown in FIGS. 7A-7D. After the heating and flow sensor solenoids 55 are mounted in position and locked into place, the inventory carousel 52 slides down over the carousel base plate 58 and gets screwed on to carousel drive shaft 65.

Figure 11:
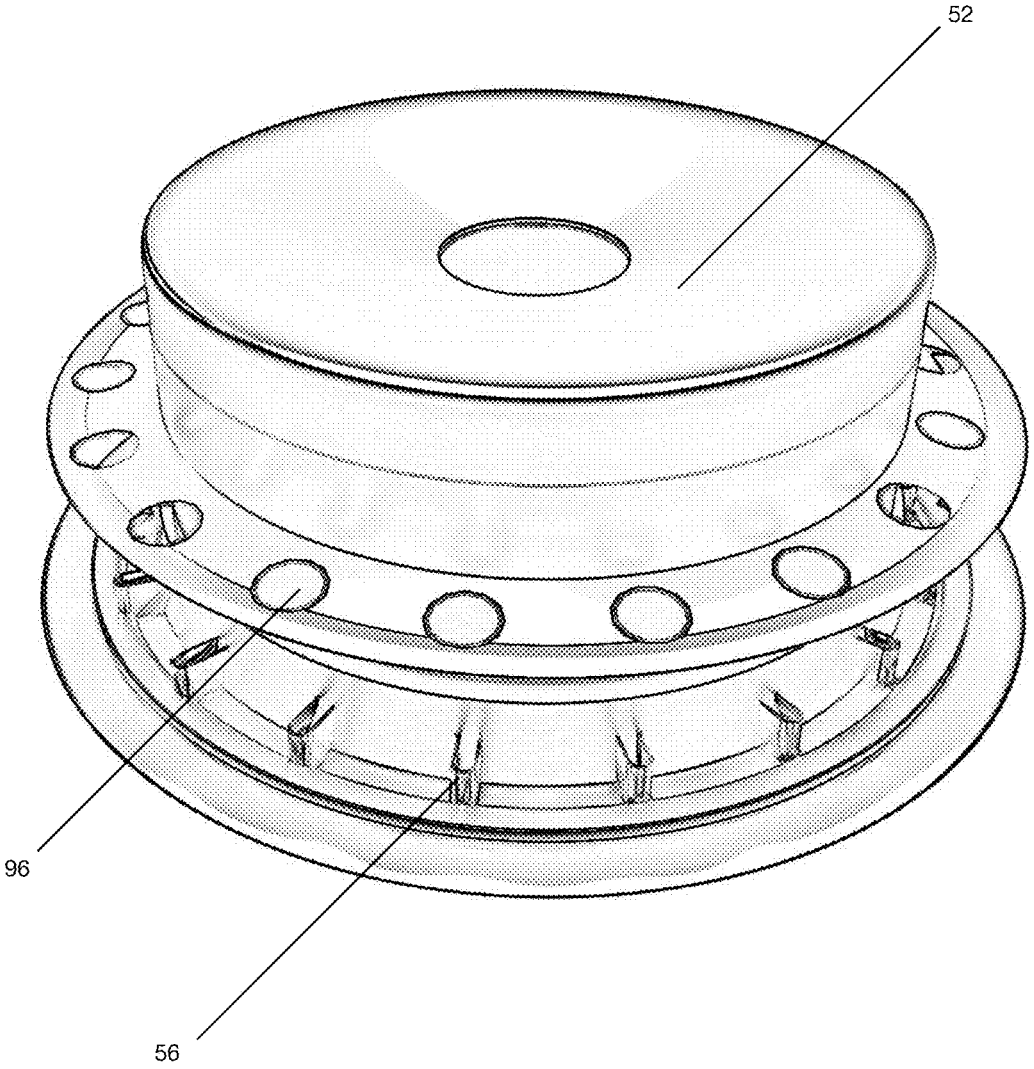
FIG. 11 is a perspective-view diagram illustrating a preferred embodiment of the carousel assembly showing inventory slots and heating and flow sensor solenoid mounts according to the various embodiments described herein.

FIG. 11 is a perspective-view diagram illustrating a preferred embodiment of the inventory carousel assembly depicting inventory carousel 52 with eighteen inventory slots 96 and heating and flow sensor solenoid mounts 97. This inventory carousel 52 is preferably made of high grade stainless steel and smooth in outer finish for easy cleaning. In a preferred embodiment, the inventory carousel assembly 52 would have various size slots 96 or optional bushings to accommodate 10-30 milliliter syringe containers.

FIG. 6 also shows the upper drive shaft cap 28 and plunger stepper motor assembly 27 which fits down on to the inventory carousel and fits down over the carousel drive shaft 65 holding it in position allowing the inventory carousel 52 to rotate freely when driven via carousel stepper drive system comprising gears 59, 60, and motor 66. The plunger stepper motor assembly 27 is also shown in FIG. 9, which is an exploded perspective view diagram illustrating a preferred embodiment of the plunger stepper motor assembly 27.

Figure 9A:
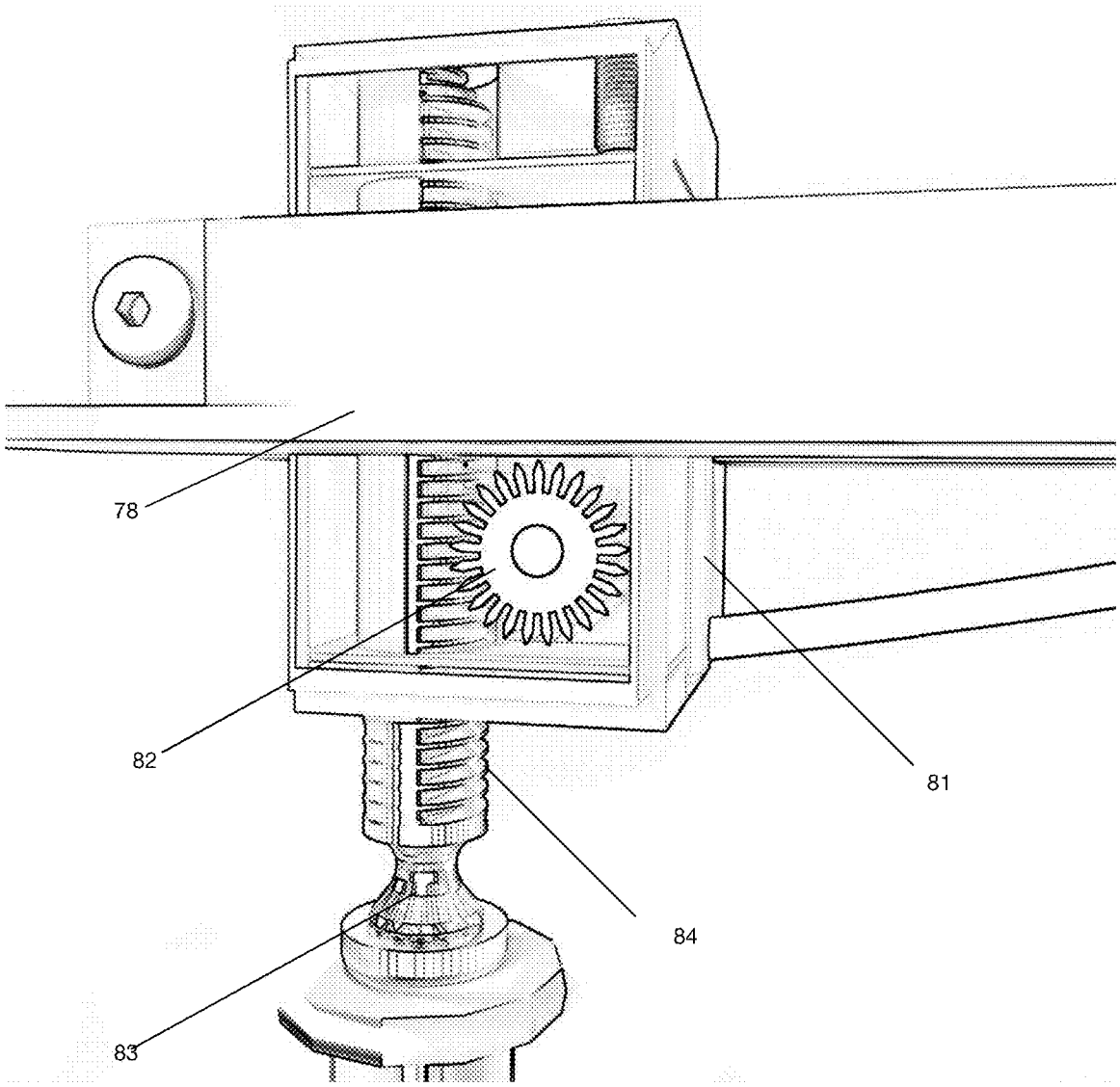
FIG. 9A is a perspective-cross cut view diagram showing a preferred embodiment depicting the upper stepper motor with stepper advance/retreat drive gear, plunger and plunger flat gear, and mounting assembly according to the various embodiments described herein.
Figure 9B:
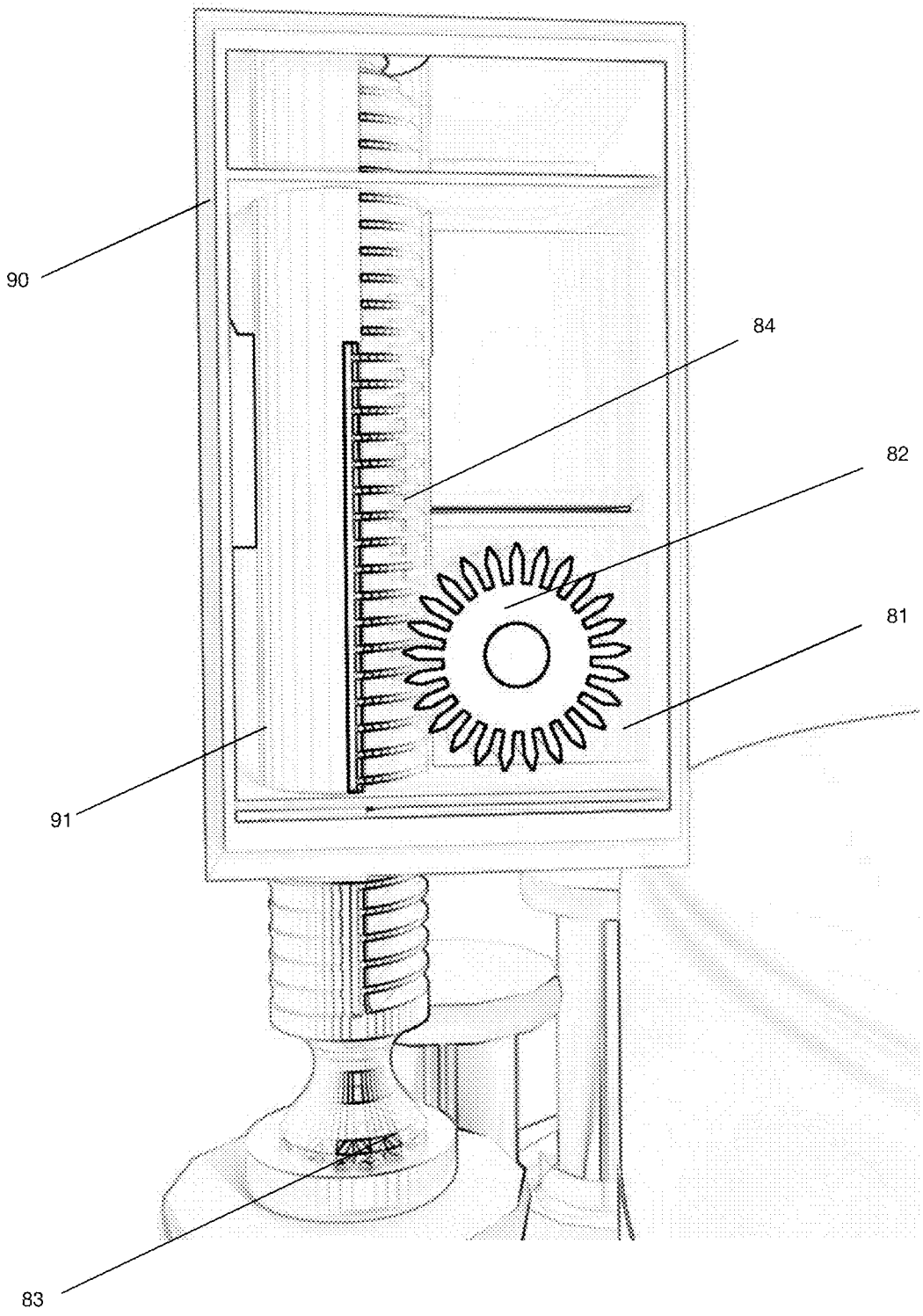
FIG. 9B is a side-cross cut view diagram showing a preferred embodiment depicting the upper stepper motor with stepper advance/retreat drive gear, plunger and plunger flat gear, and casing assembly with plunger shaft channel according to the various embodiments described herein.

FIGS. 9A and 9B illustrate the preferred configuration of the plunger motor assembly 27 comprising a stepper motor driving the main drive gear 82 which has a purpose of incrementing the stepper plunger 83 via the gear tracks 84 on the plunger's side. Main drive gear 82 is housed in drive gear inner housing and plunger stepper motor 81, and gear box out housing 90. Plunger 83 is housed in a plunger housing 91. The plunger 83 is preferably made of stainless steel and its purpose is to depress the inventory syringe plunger 37 to push out the exact amount of ingredient through the heater and flow gauge sensor solenoid 55 (see FIGS. 7A-7D), where it is temperature controlled. The chamber heater 71 and flow sensor solenoid 55 give direct feedback to the plunger stepper motor, managing the amount of liquid passing through its chambers 74, thereby matching the formula set requirements. This provides an onboard flow control that measures the amount of fluid passing through it to determine the output of that ingredient which tells the motherboard logic when to turn off and on the motor.

Figure 7A:
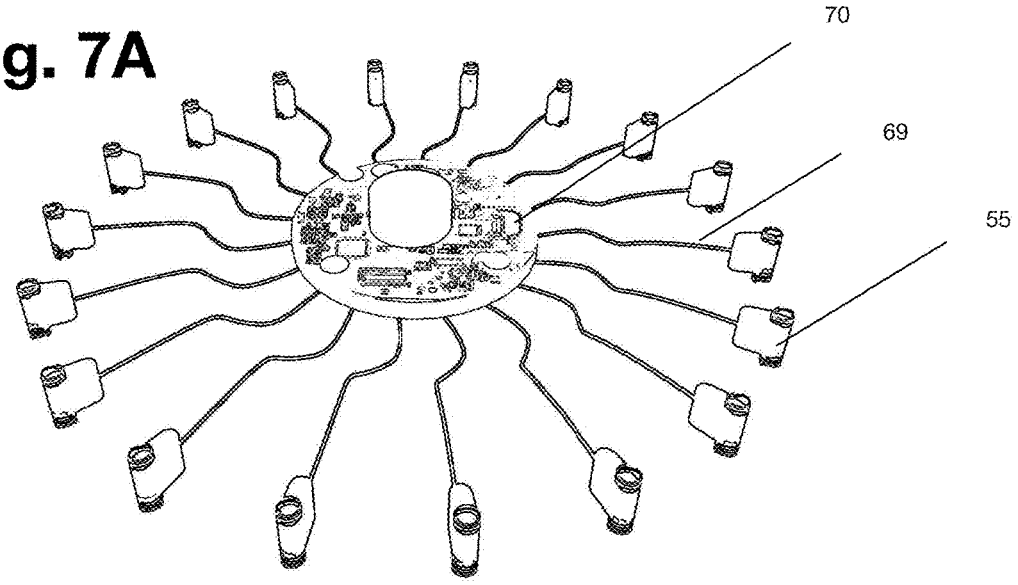
FIG. 7A is a perspective-view diagram showing a preferred embodiment of the heating and flow sensor solenoid, wiring harness and junction board according to the various embodiments described herein.
Figure 7B:
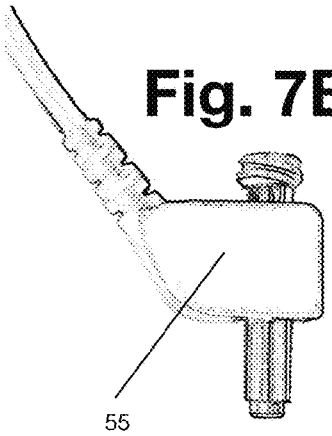
FIG. 7B is a side-view diagram showing a preferred embodiment of the heating and flow sensor solenoid according to the various embodiments described herein.
Figure 7C:
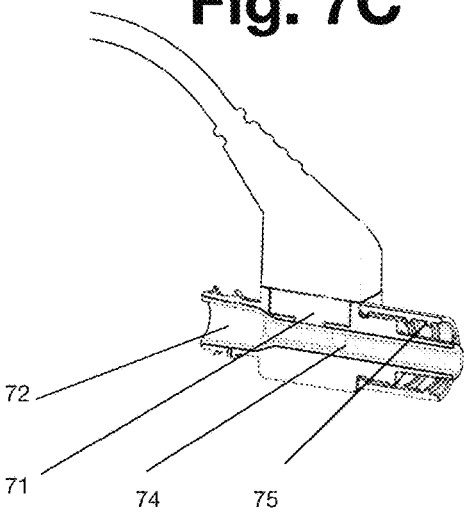
FIG. 7C is a perspective-cross cut view diagram showing a preferred embodiment depicting the components of the heating and flow sensor solenoid and luer-lock adapter input and output according to the various embodiments described herein.
Figure 7D:
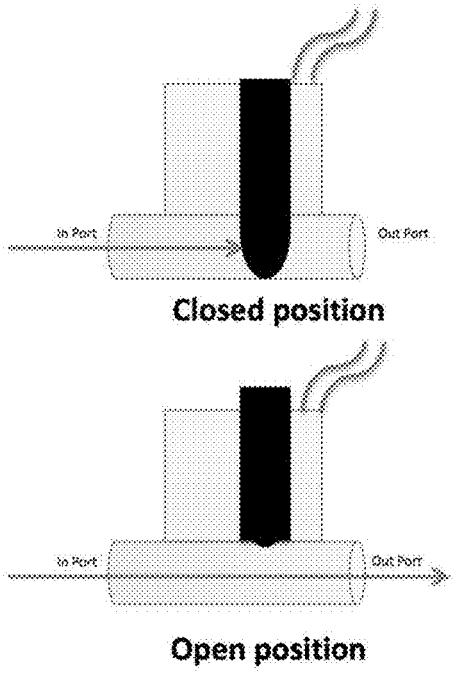
FIG. 7D is a cross cut view diagram showing a preferred embodiment depicting the flow sensor solenoid 5 v pulsing movement and job function according to the various embodiments described herein.

FIG. 7A is a perspective-view diagram showing a preferred embodiment of the heating and flow sensor solenoid 55, wiring harness 69 and wire bus connection board or junction board 70. FIG. 7B is a side-view diagram showing a preferred embodiment of the heating and flow sensor solenoid 55. FIG. 7C is a perspective-cross cut view diagram showing a preferred embodiment depicting the components of the heating and flow sensor solenoid 55 and luer-lock adapter input 72 and output 75. FIG. 7D is a cross cut view diagram showing a preferred embodiment depicting the flow sensor solenoid 5 v pulsing movement and job function.

Figure 8:
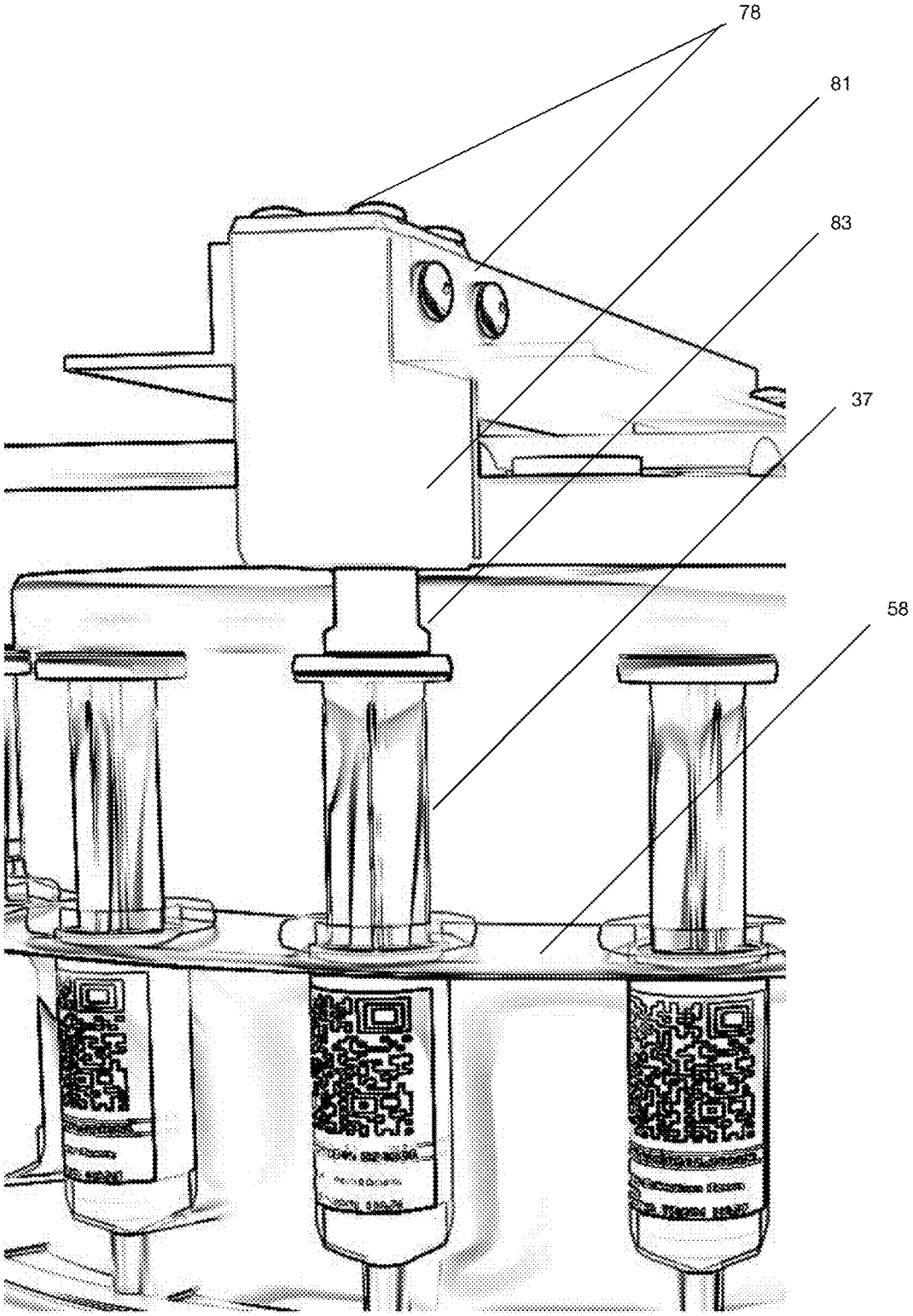
FIG. 8 is a perspective-view diagram illustrating the upper stepper motor, plunger and mounting assembly positioned over the selected inventory cartridge plunger mounted in carousel according to the various embodiments described herein.

FIG. 6 shows the preferred disposable syringe tips 61. FIGS. 8 and 9A also show how the plunger stepper motor and its associated plunger 83 are mounted by steel rails 78 that are mounted to the chassis. These figures also show how the plunger 83 is lined up exactly with the inventory syringe plunger 37.

Figure 10A:
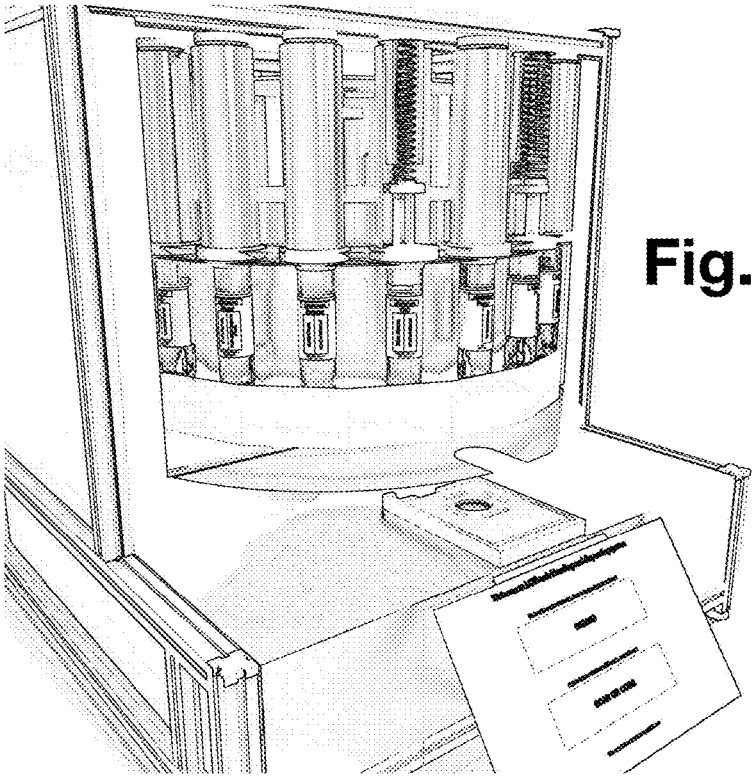
FIG. 10A is a perspective-view diagram illustrating an alternate embodiment of the carousel assembly showing constant pressure spring activated plungers according to the various embodiments described herein.
Figure 10B:
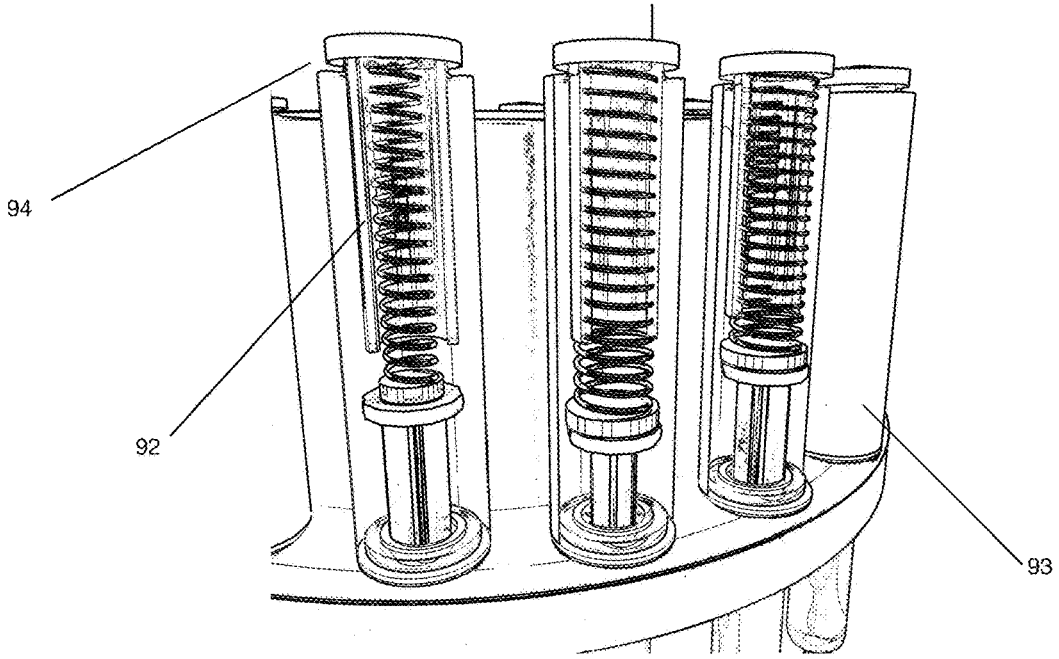
FIG. 10B is a side-cross cut view diagram showing an alternate embodiment depicting constant pressure spring activated plungers with casing according to the various embodiments described herein.

FIGS. 10A and 10B are perspective-view diagrams illustrating an alternate embodiment of the carousel assembly showing constant pressure spring activated plungers 92 replacing motor plunger system according to the various embodiments described herein. FIG. 10B shows a closeup perspective view illustrating this alternate embodiment of the blending station plunging system, with constant tension pressure spring plungers instead of a motorized process. Each spring 92 is housed in a pressure spring housing 93 having a pressure spring housing cap, and keeps smooth constant pressure on an associated syringe plunger 37, and accurately dispensed via the sensor solenoid. Springs can vary in resistance and size. The solenoid pulses open and closed at a rapid rate up to 0.0001 ms (FIG. 7D) until inline scale 17 reaches required weight directed in the formula according to the various embodiments described herein.

Figure 13:
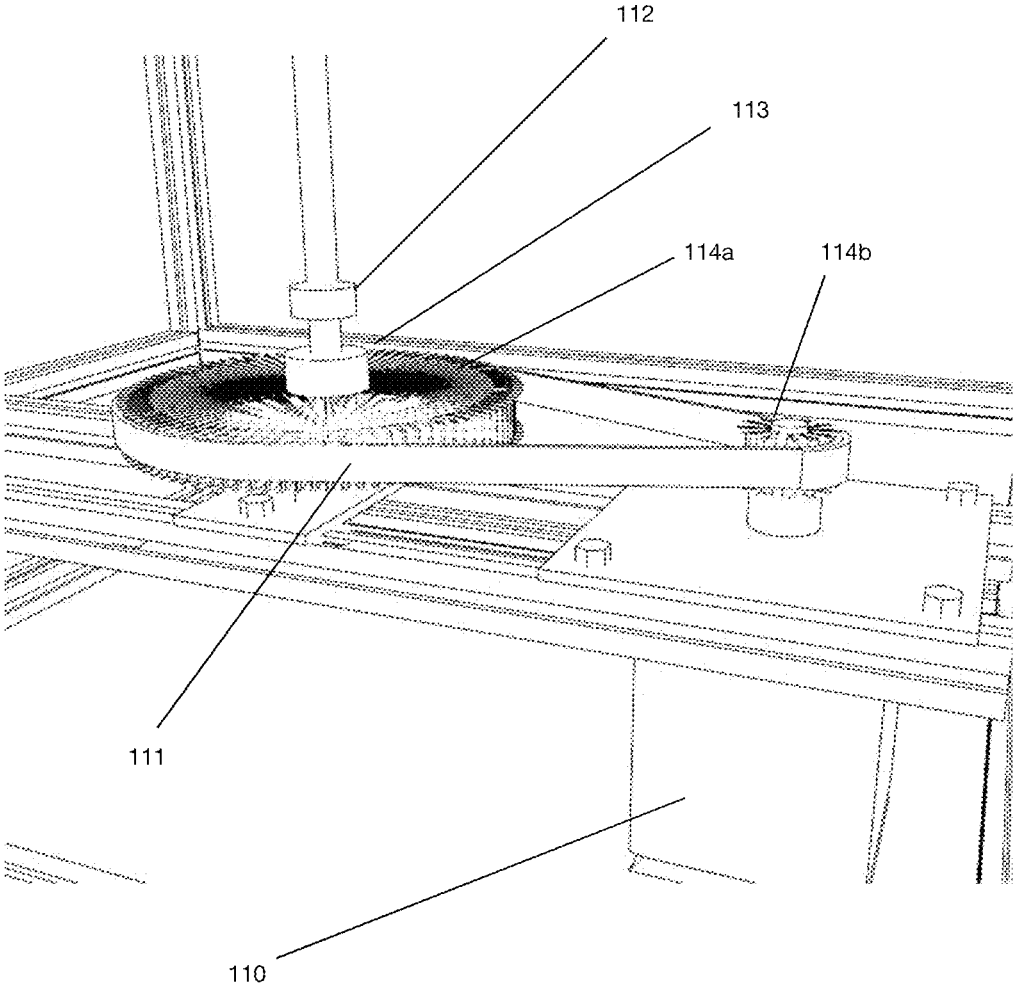
FIG. 13 is a perspective view diagram illustrating an alternate embodiment of the carousel shaft assembly drive according to the various embodiments described herein.

FIG. 13 is a perspective-view diagram illustrating an alternate embodiment of the carousel drive assembly showing master and slave timing pulleys 114*a* and 114*b*, and XL250 timing belt 111, replacing gears 59 and 60 (FIGS. 12A and 12B). The pulley system is a 6:1 90/15 ratio and is used for increased torque and stopping capabilities. A quadratic encoder 113 is used to get drive shaft position and has 1024 increments for precision rotation positioning. Inline brake assembly 112 locks and unlocks shaft via a +12 volt control pulse and is used to hold the shaft in place during the dispensing process once positioning is reached according to the various embodiments described herein. A stepper motor 110 is used to drive the pulley system.

Figure 14:
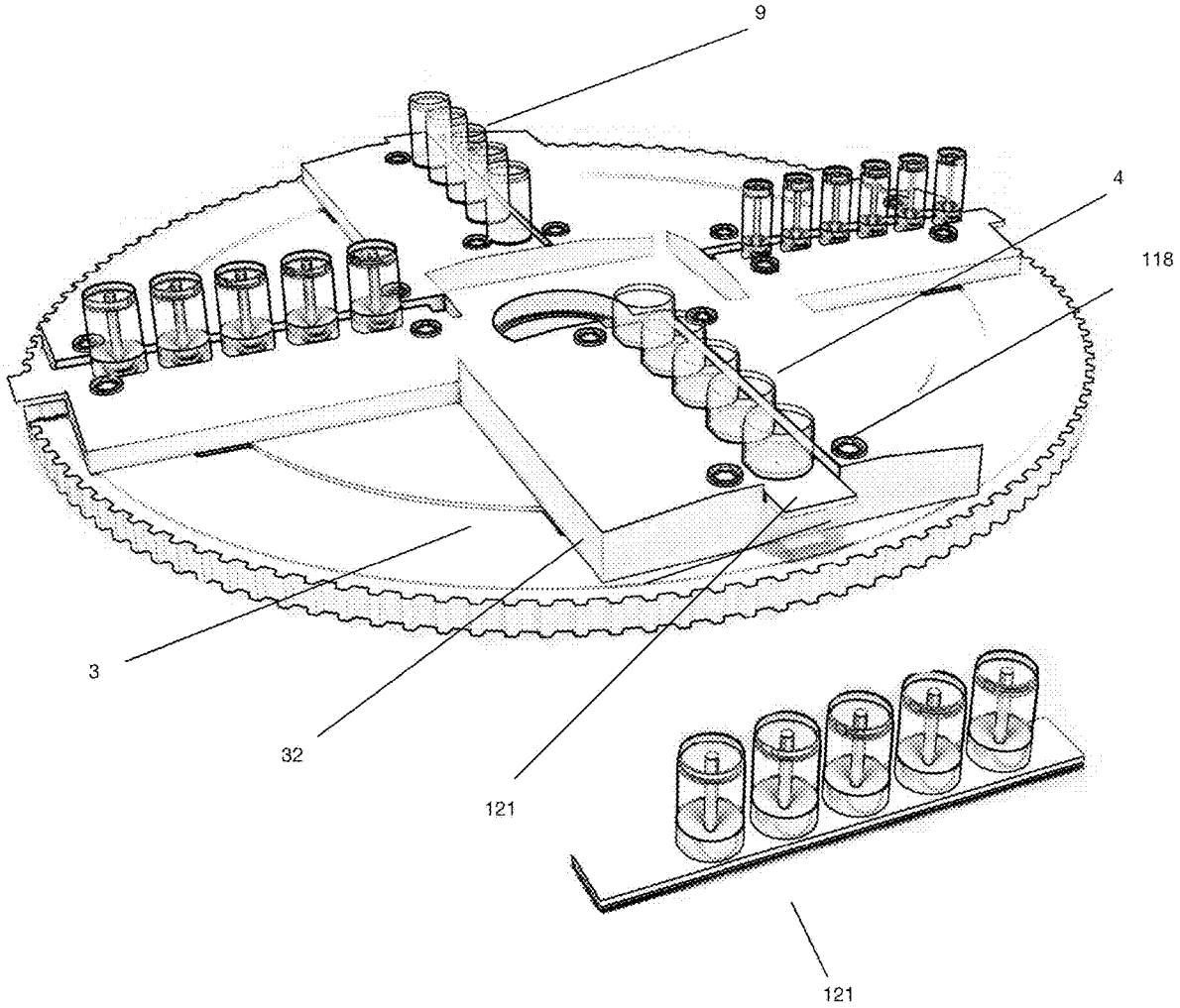
FIG. 14 is a perspective-view diagram illustrating a preferred embodiment of the output base platter and adjustable cartridge and dab jar mounts according to the various embodiments described herein.

In FIG. 14, which is a perspective-view diagram illustrating a preferred embodiment of the output base platter 3, and a preferred placement of the adjustable cartridge and dab jar mounts 32 which are adjusted by set screws 118 and are configured to hold any of the multi pack cartridges 9 or dab jars 4 and custom sizes in place for filling. In a presently preferred embodiment, the system includes disposable multipack slide in, sticky back, stick replacements 121. Although multipack slide in stick replacement 121 is displayed, it is just a preferred configuration and the base platter 3 allows for single vessel and other methods as well.

Figure 15A:
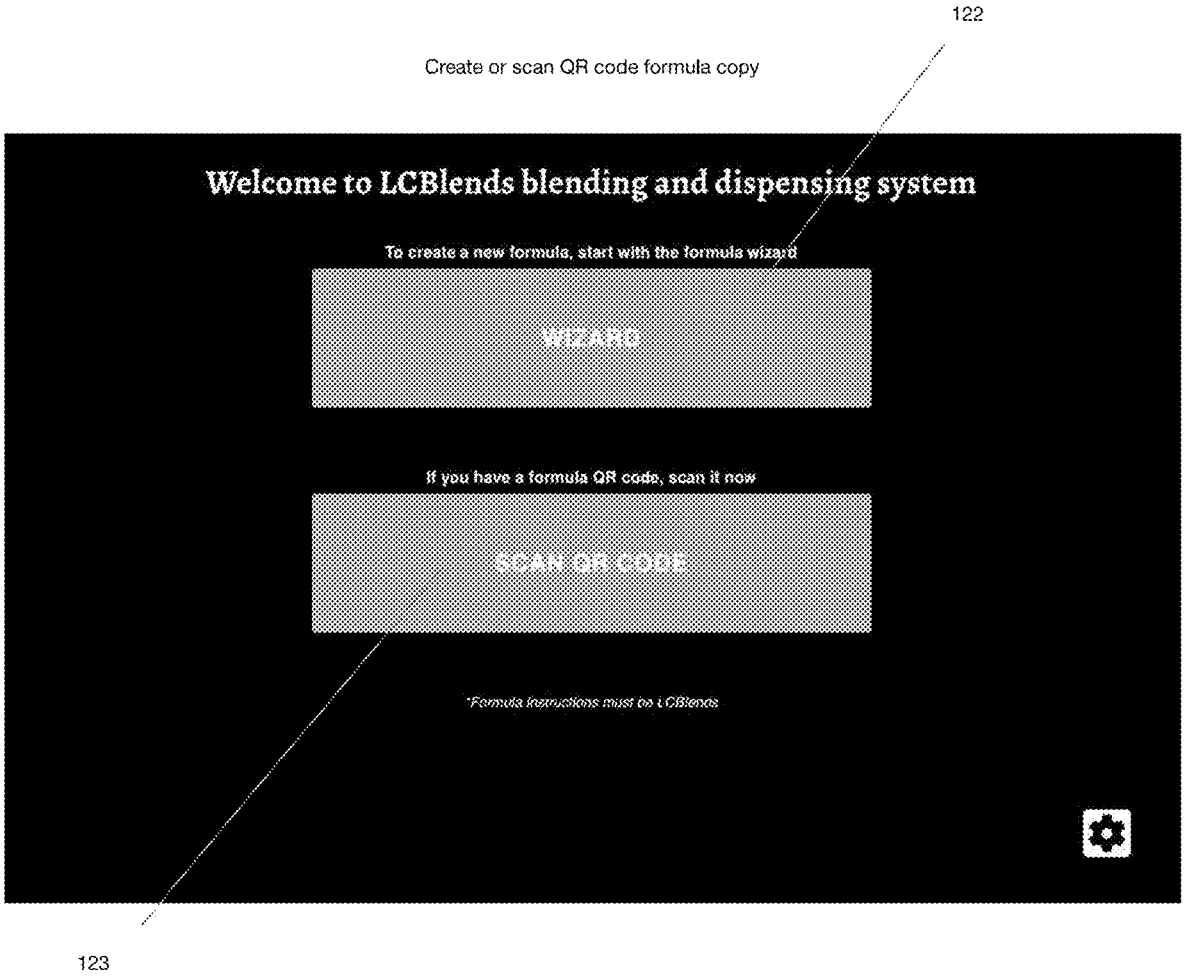
FIG. 15A illustrates a preferred embodiment of software utilization showing the main menu screen image according to the various embodiments described herein.

FIG. 15A illustrates a preferred embodiment of software utilization showing the main menu screen image which allows the user two options, one to create custom blended liquid *cannabis* formulas via the formula wizard 122, or the other to have the ability to scan a formula QR code 123 and replicate and dispense that exact formula. The blending station software application is used for many processes. The main functionality is to create custom liquid *cannabis* formulas and allow the user to print a personal formula card or send an e-formula card via email to users or customers for future use, when formula replication is needed. The blending station software application is also used for creating and setting up sales orders which consists of setting up a customer's order for a specific quantity of given formula, with a specific output requirement. The application will also calibrate the cost and sale price for the various individual ingredients used in the formulas. The application allows the user to both create formulas and dispense ingredients based on that formula and produce a detailed invoice including all prior history associated with the individual ingredients used in the formula. The blending station software application also manages the inventory library allowing a user to add, delete, and/or edit the inventory library items, keeping it in sync with the inventory cartridges 36 in inventory carousel 52 (see FIG. 6), which a user uses to select ingredients while creating the formula blends. The application also supports analytic API's for scientific research and clinical trials, which optionally could be provided as a software upgrade.

In a preferred embodiment the blending station software application would run on a preferred motherboard which includes a CPU, persistent storage, volatile storage, input device, output device and a network interface, as described above with respect to FIG. 5.

Figure 15B:
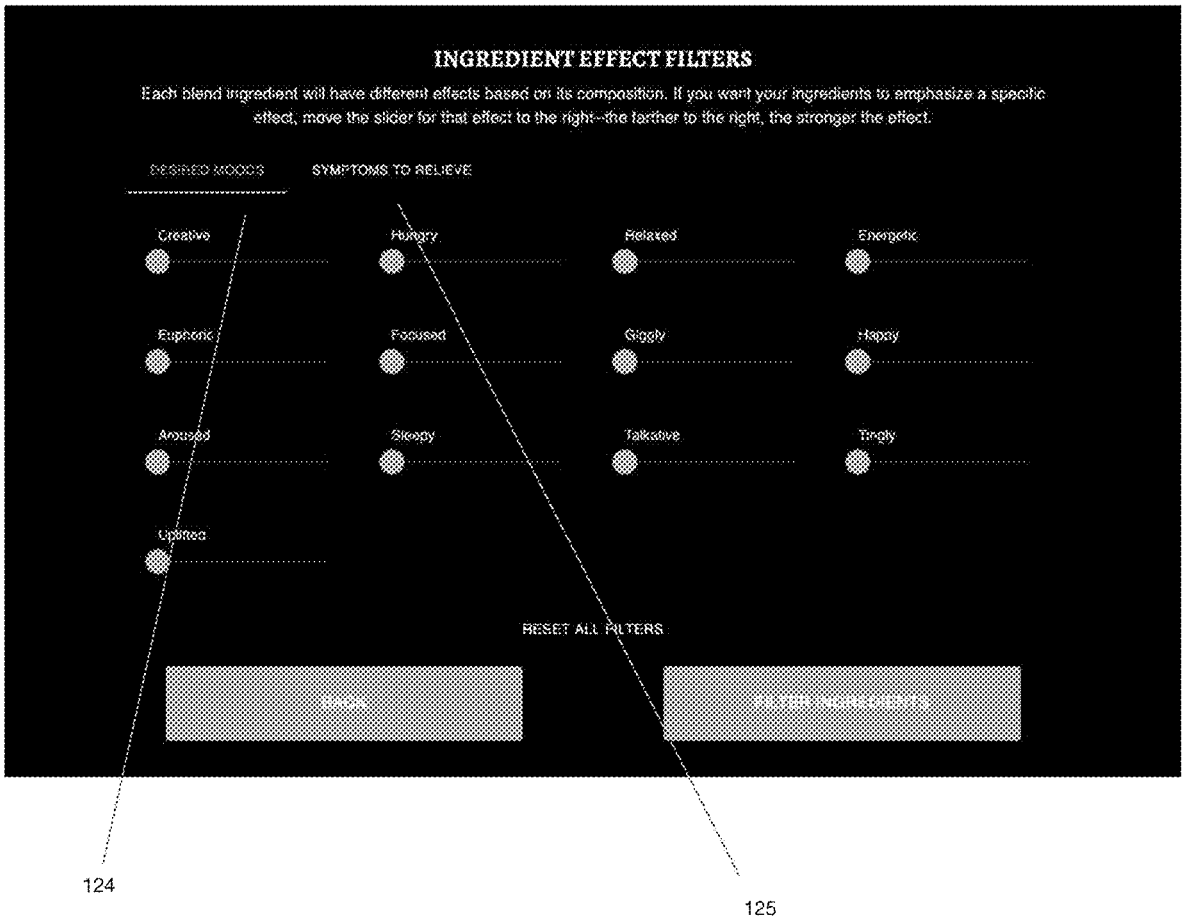
FIG. 15B illustrates a preferred embodiment of software utilization showing the Ingredient filter screen image according to the various embodiments described herein.

FIG. 15B illustrates a preferred embodiment of software utilization showing an image of an ingredient filter screen which allows a user to create a list of pre-filtered ingredients based on user settings of ingredient effect filters. This aids and allows the user to create a custom ingredient library targeting their specific needs via the formula filter wizard mood effect mixer 124 and/or the symptom effect mixer 125. The mixer result then filters the library view to items that match filter criteria.

Figure 15C:
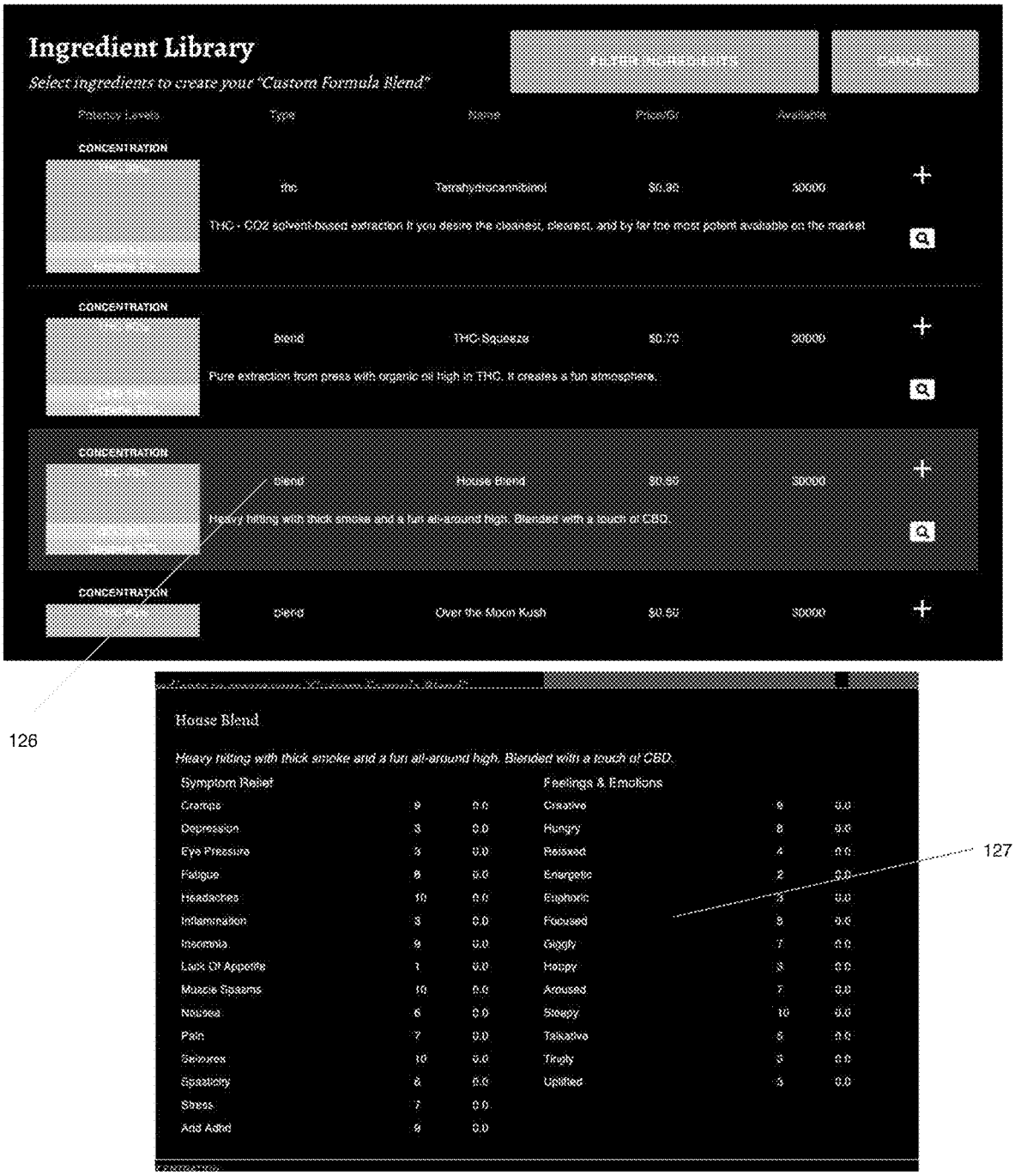
FIG. 15C illustrates a preferred embodiment of software utilization showing the Ingredient library selection screen image according to the various embodiments described herein.

FIG. 15C illustrates a preferred embodiment of software utilization showing an image of the ingredient library selection screen which allows the user to select and combine ingredients from the library 126 targeting their specific needs. Each item in the library has a complete filter attribute listing with filtering index 127. The filter index would be utilized when targeting a desired mixture outcome by eliminating unwanted or unneeded ingredients in a formula.

Figure 15D:
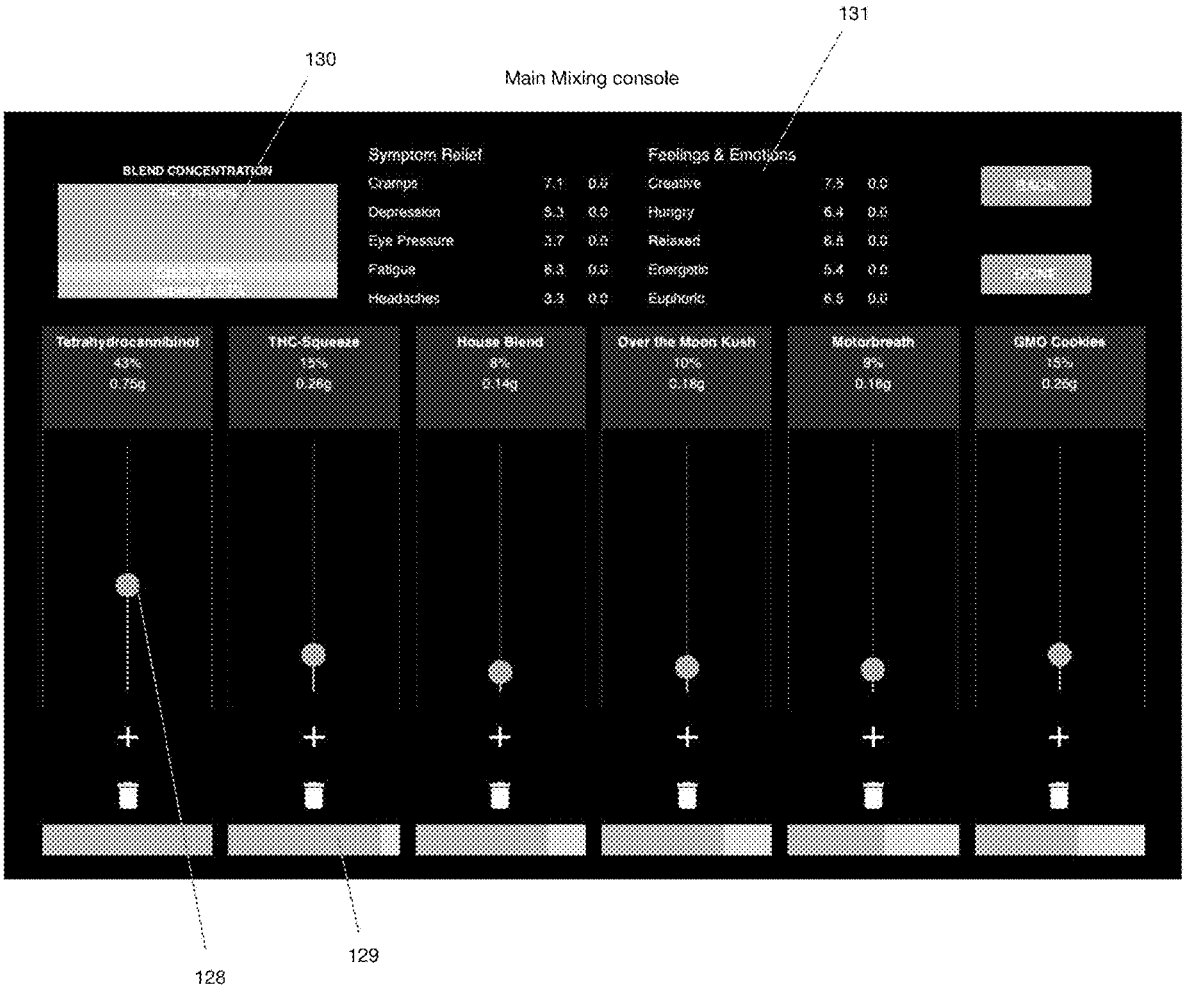
FIG. 15D illustrates a preferred embodiment of software utilization showing the Main Mixing Console screen image according to the various embodiments described herein.

FIG. 15D illustrates a preferred embodiment of software utilization showing an image of the main mixing console screen which allows the user to select and combine a mixture of ingredients to target their specific outcome. This includes use of a mixer 128 to individually add or increase, or remove or decrease amounts of specific ingredients. The main mixing console screen also includes a THC meter 129 to warn user of high THC content, as well as a detailed attribute index HUD 131 and a blend concentration meter 130.

Figure 15E:
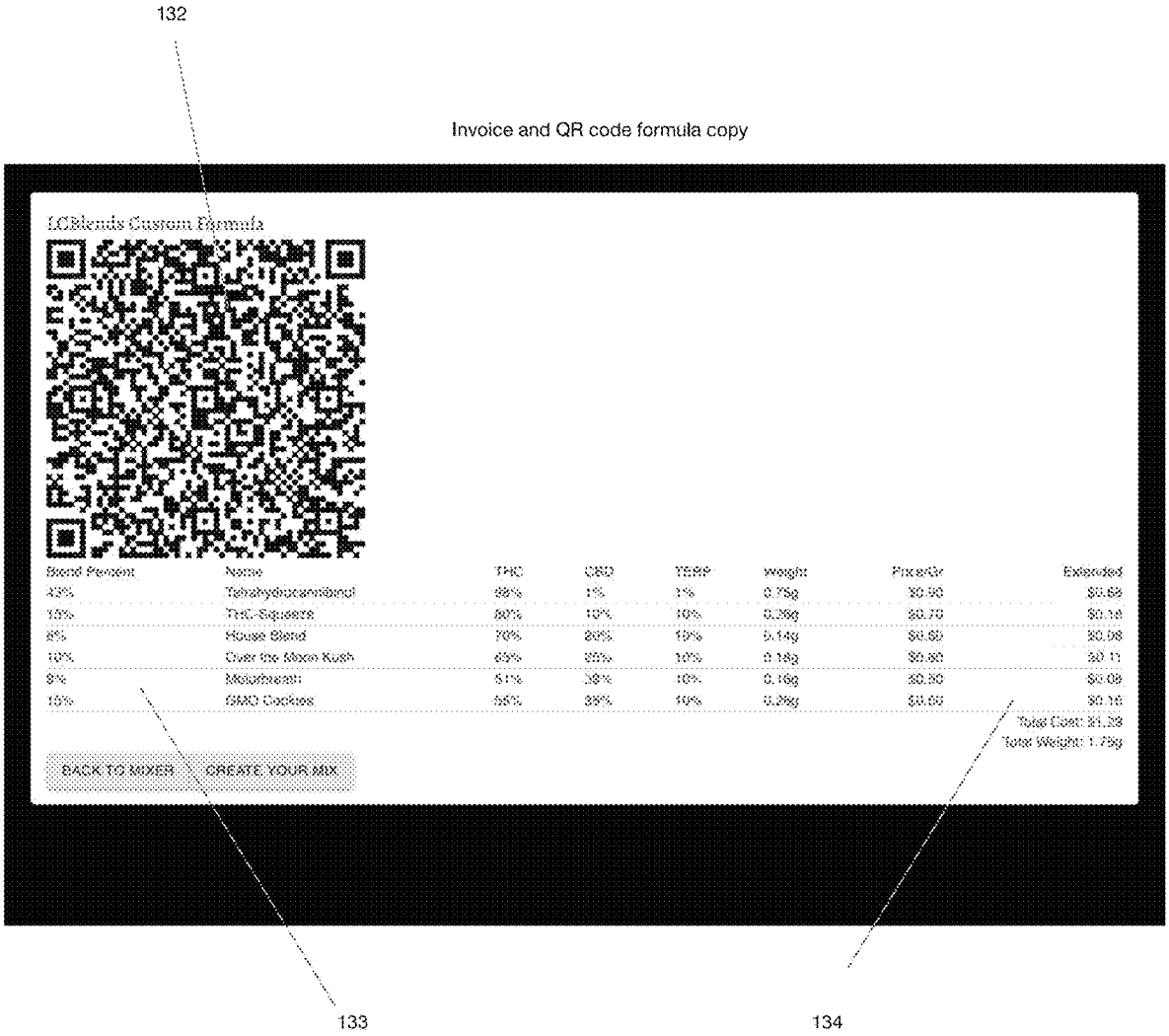
FIG. 15E is an illustration showing the preferred embodiment of a custom formula invoice according to the various embodiments described herein.

FIG. 15E is an illustration showing the preferred embodiment of a custom formula invoice and the preferred positioning of the custom formula QR-code 132 generated by the system and the formula detail including mix ratio or blend percentage 133 with potency and matter type. A specific example of suitable *cannabis* liquids would include, but not limited to, THC, CBD, Terpenes, thinners and various flavorings. After calibrating the cost and sale price 134 for the various ingredients used in the formula, based on the specific quantity requested, the system and software produces a detailed invoice including all prior history associated with the individual ingredients, which could be printed or emailed, with the formula code, to the user for future use. It is to be understood that the teachings herein can be modified for other presently known or future liquids according to the various embodiments described herein.

FIG. 18 is an illustration showing the preferred embodiment of a custom formula card 44 in print form and/or in email form depicting the preferred positioning of a custom formula QR-code 136 generated by the blending station software application, and the formula detail 137 including mix ratio 138, potency 139 and matter type 140. A specific example of a suitable *cannabis* liquids would include but not limited to THC, CBD, Terpenes, thinners and various flavorings. It is to be understood that the teachings herein can be modified for other presently known or future liquids according to the various embodiments described herein.

Figure 20:
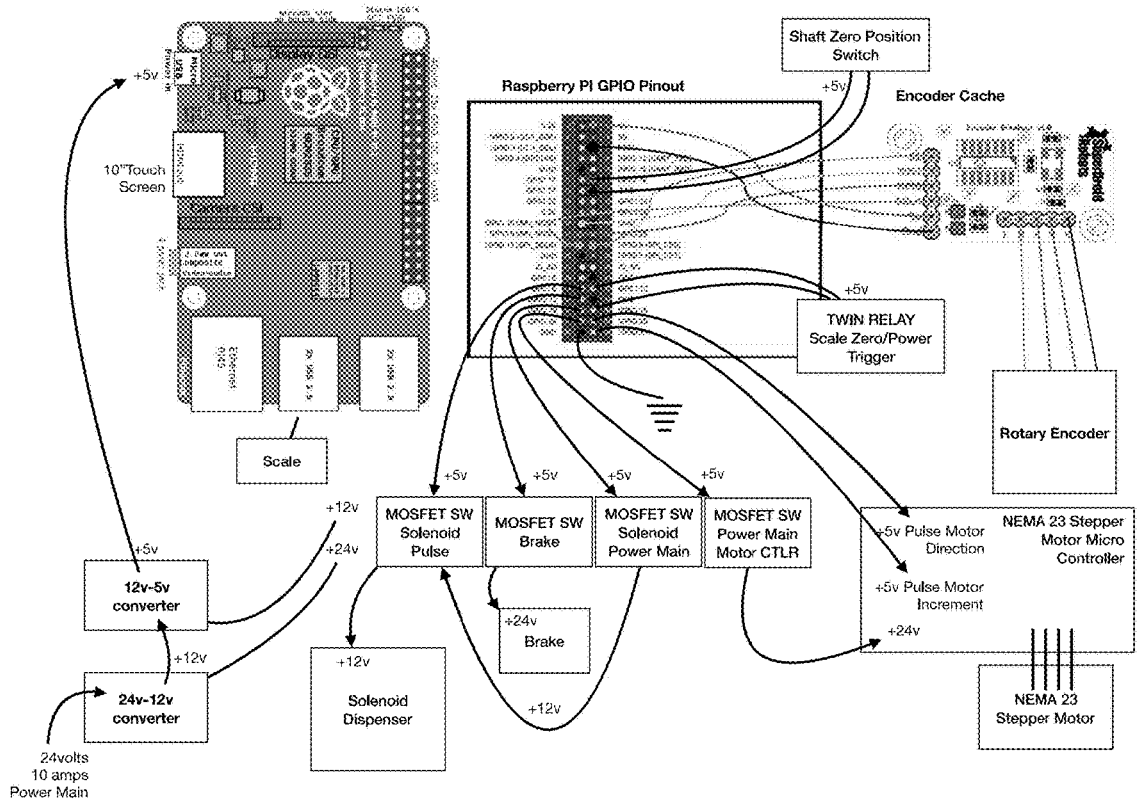
FIG. 20 is a diagram illustrating a preferred power and logic wiring flow map.

FIG. 20 is a diagram illustrating a preferred embodiment of the method and system of the present disclosure depicting the preferred power and logic wiring configuration. The system preferably runs on an external 24 volt 10 amp power pack. It is to be understood that the teachings herein can be modified for other presently known or future configurations according to the various embodiments described herein.

Figure 16:
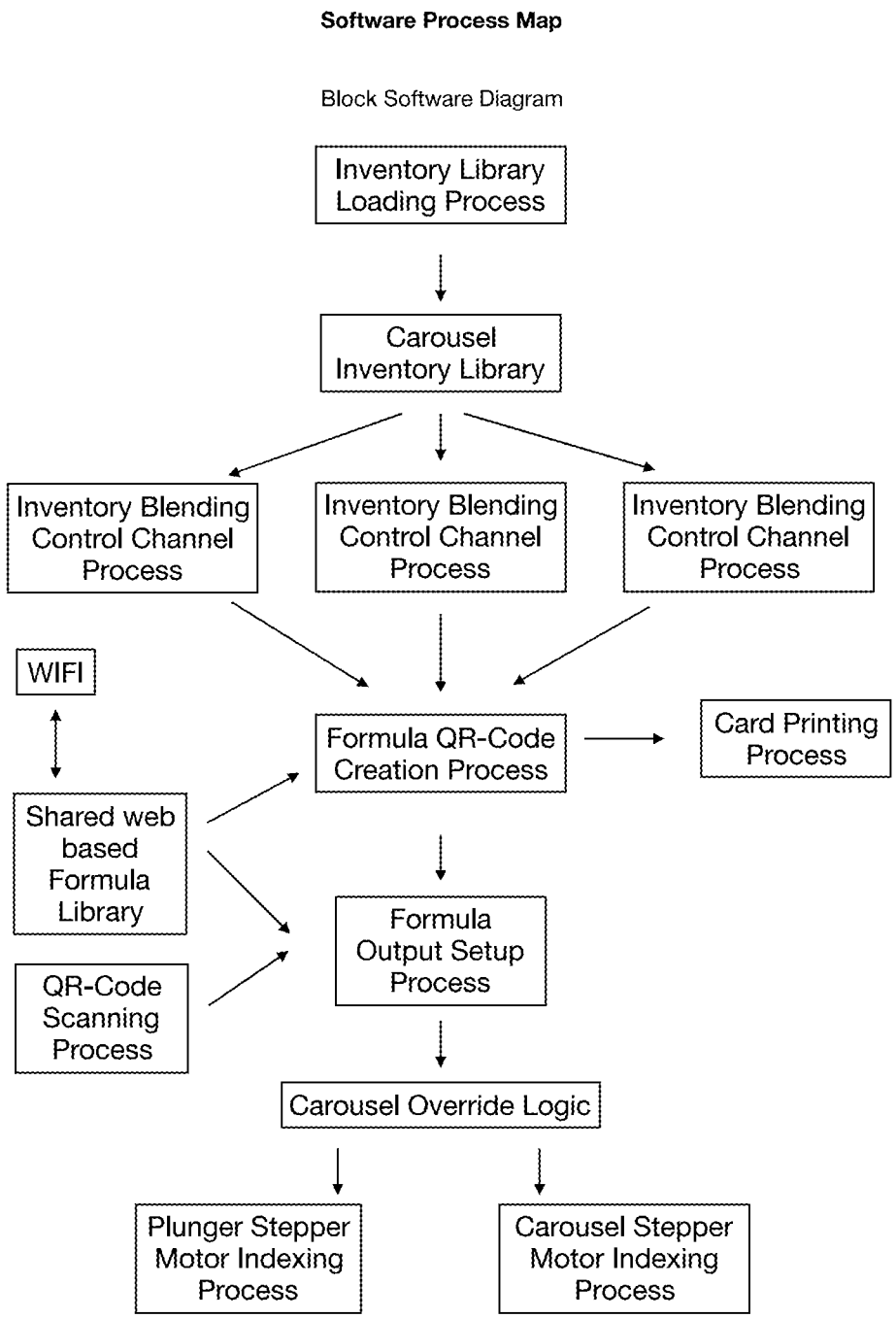
FIG. 16 is a software process map diagram illustrating a preferred software process flow according to the various embodiments described herein.
Figure 17A:
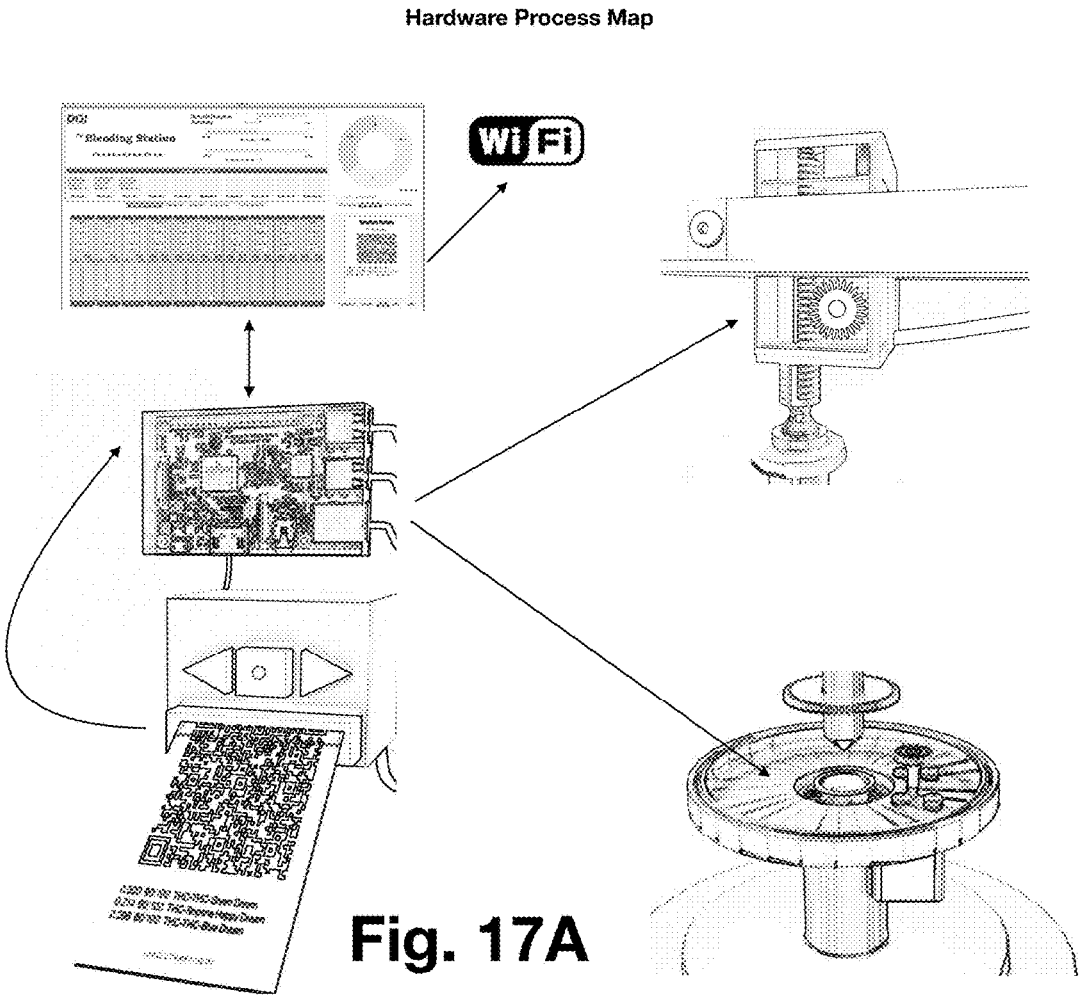
FIG. 17A is a system hardware diagram illustrating a hardware process flow according to the various embodiments described herein.
Figure 17B:
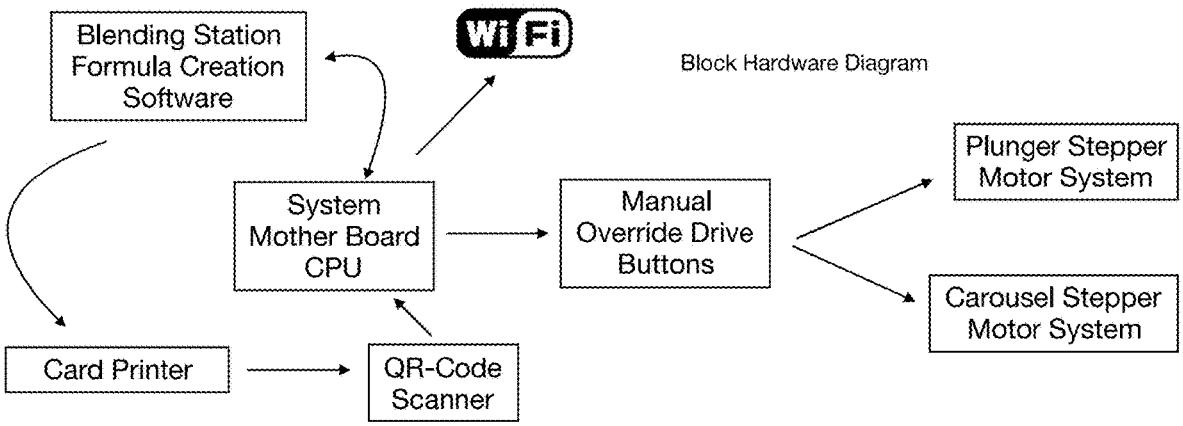
FIG. 17B is a block hardware diagram depicting the preferred hardware process flow and connection between the preferred hardware items according to the various embodiments described herein.

FIG. 16 is a software process map diagram illustrating a preferred embodiment of the method and system showing the preferred software process flow according to the various embodiments described herein. FIG. 17A is a system hardware diagram illustrating a preferred embodiment of the method and system showing the preferred hardware process flow according to the various embodiments described herein. FIG. 17B is a block hardware diagram showing a hardware process map diagram illustrating a preferred embodiment of the method and system showing the preferred hardware process flow and connection between the preferred hardware items according to the various embodiments described herein.

In a preferred embodiment of the method and system, the core functionality would comprise personalized formula cards. A personalized formula is stored in the QR code, queueing up exact blends of THC, CBD, terpenes and/or non-*cannabis*-flavored thinners. Precision motor systems automatically select and dispense precise amounts of each of the ingredients necessary to formulate the precise blend derived from the scan card info. The blending station's preferred 18-slot carousel offers an endless variety for custom blends. Each slot has built-in heating and flow sensor solenoids for smooth and accurate product dispensing. The cartridge-filling carousel accommodates most vape cartridges, dab jars and custom containers with an adjustable mounting system and includes reload strips for quick mounting and service. To prevent cross-contamination, refill cartridges of THC, CBD, terpenes and non-*cannabis* additives (for flavoring and thinning) are standard 10-30 ml disposable plastic syringe containers typically used to store and transport deconstructed *cannabis* oils after distillation.

Formula development software accesses custom formula libraries and supports the creation of custom blends and manual operation. The blending station's design enables easy refill loading with manual override controls. An ultra-smooth cabinet finish allows for easy cleaning. Powered by a single CPU, the blending station is "ready out of the box" with blending station formula builder software and wireless internet connection, e.g., WiFi for automatically maintaining upgrades and optional custom formula sharing.

Figure 19:
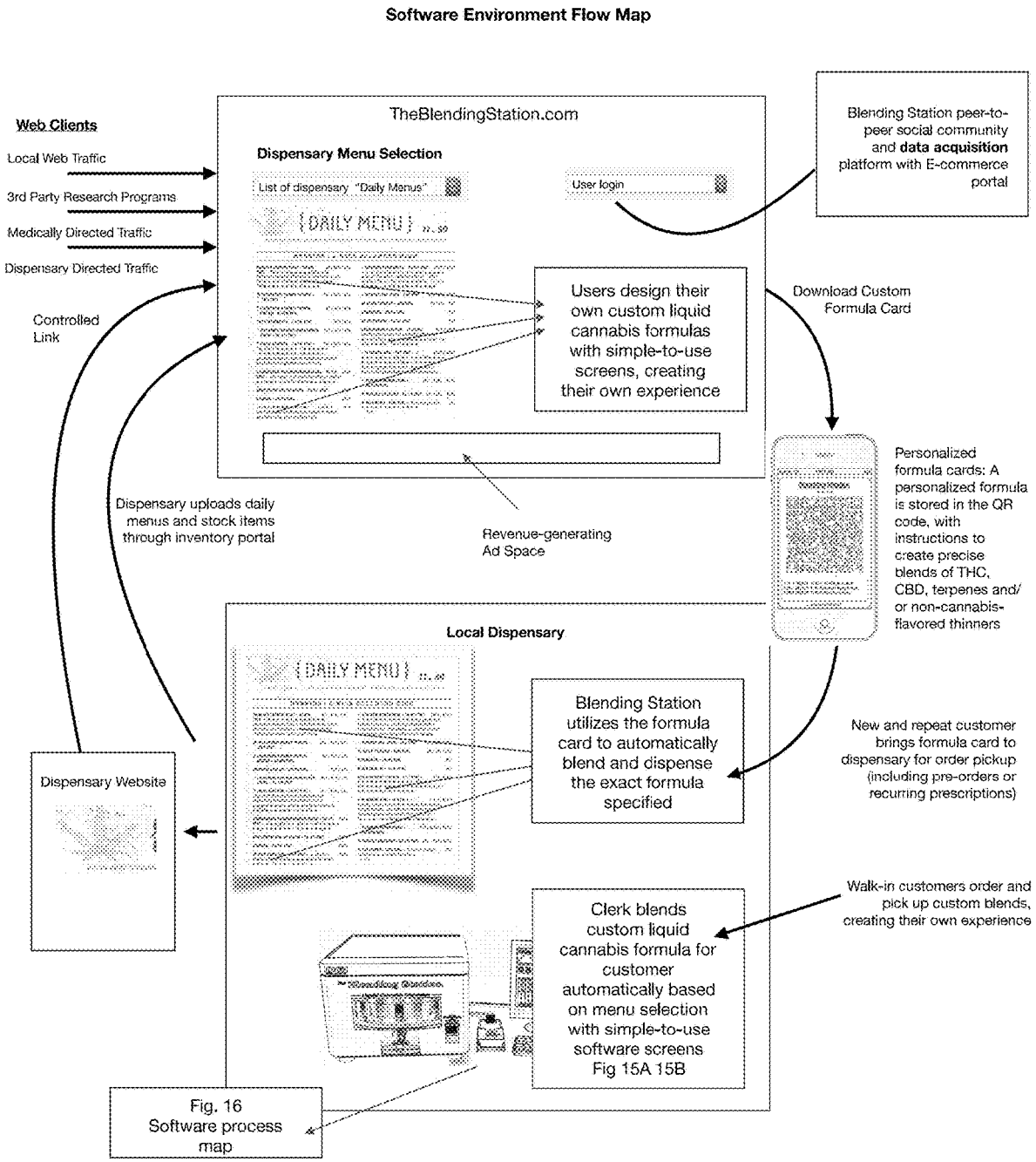
FIG. 19 is a diagram illustrating a preferred software environment flow map.

FIG. 19 is a diagram illustrating a preferred embodiment of the method and system depicting the preferred software environment flow map, showing a cloud based software portal connecting dispensaries, customers and a central data collection site. Web traffic can design their own formula cards based on the participating dispensaries and their available inventory. Research trial users can be directed to a specific formula blend, and the medical industry can directly control patient ratios. It is to be understood that the teachings herein can be modified for other presently known or future configurations according to the various embodiments described herein.

While the present invention has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method and system illustrated herein and of their operation can be made by those skilled in the art, without departing from the spirit of this invention.

While the embodiment(s) disclosed herein are illustrative of the structure, function and operation of the exemplary method(s), system(s), component(s) and device(s), it should be understood that various modifications may be made thereto with departing from the teachings herein. Further, the components of the method(s), system(s), component(s) and device(s) disclosed herein can take any suitable form, including any suitable components capable of adequately performing their respective intended functions, as may be known in the art.

While the foregoing discussion presents the teachings in an exemplary fashion with respect to the disclosed method (s), system(s), component(s) and device(s) for blending and dispensing liquid *cannabis*, it will be apparent to those skilled in the art that the present disclosure may apply to other chemical and/or drug and/or liquid dispensing method (s) and system(s). Further, while the foregoing has described what are considered to be the best mode and/or other examples, it is understood that various modifications may be made therein and that the subject matter disclosed herein may be implemented in various forms and examples, and that the method(s), system(s), component(s) and device(s) may be applied in numerous applications, only some of which have been described herein.

The terminology used herein is for the purpose of describing particular environments only and is not intended to be limiting of the method and system. As used herein the term "and/or" includes any and all combinations of one or more of the associated listed items. As used herein the singular forms 'a' 'an' 'and' and 'the' are intended to include the plural forms as well as the singular forms unless the context clearly indicates otherwise. It will be further understood that the terms "comprises" and/or "comprising" when used in this specification specify the presents of stated features, steps, operations, elements and/or components but do not conclude the presence or addition of one or more other features, steps, operations, elements, components and/or groups thereof.

Unless otherwise defined, all terms (including technical and scientific terms) used herein have the same meaning as commonly understood by one having ordinary skill in the art to which the invention belongs. It will be further understood that terms such as those defining commonly used dictionary terms, should be interpreted as having a meaning that is consistent with their meaning in the context of the relevant art and the present disclosure and will not be interpreted in an idealized or overly formal sense since expressly so defined herein.

In describing the methods and systems herein, it will be understood that a number of techniques and steps are disclosed. Each of these have individual benefits and each can also be used in conjunction with one or more or in some cases all of the other disclosed techniques. Accordingly, for the sake of clarity this description will refrain from repeating every possible combination of the individual steps in an unnecessary fashion. Nevertheless, the specification and claims should be read with the understanding that such combinations are entirely within the scope of the claims.

What is claimed is:

1. A liquid *cannabis* blending and dispensing device, comprising:

a carousel and a carousel drive assembly;

a plurality of syringe cartridges held in the carousel, wherein the plurality of syringe cartridges each include a syringe plunger and contain a liquid;

a plurality of constant pressure spring activated plunger assemblies associated with the plurality of syringe cartridges for selectively dispensing liquid from the plurality of syringe cartridges, wherein each of the plurality of syringe cartridges is mounted below one of the plurality of constant pressure spring activate plunger assemblies; and a receptacle for receiving the dispensed liquid from the plurality of syringe cartridges.

2. The device of claim 1, further comprising a flow sensor solenoid associated with each of the plurality of syringe cartridges for controlling dispensing of the liquid.

3. The device of claim 2, further comprising a heating chamber associated with each flow sensor solenoid for heating of the liquid.

4. The device of claim 1, further comprising a rotating output base platter below the carousel.

5. The device of claim 1, further comprising a QR code reader, and associated formula creator software for creating a formula stored in a QR code, wherein the QR code contains information related to formula ratio, description, potency quantity and ingredient profile.

6. The device of claim 1, further comprising manual navigation override buttons for overriding the carousel drive assembly and selectively moving the carousel.

7. The device of claim 1, further comprising a cabinet having a hinged cover and a locking system for securing the plurality of syringe cartridges.

8. The device of claim 2, further comprising a window in a portion of the cabinet, wherein the window displays a portion of the carousel.

9. The device of claim 4, further comprising adjustable jar mounts on the rotating output base platter for selectively securing the receptacle.

10. The device of claim 5, further comprising a CPU, memory storage, input and output ports, and a network interface.

11. The device of claim 1, further comprising a scale below the carousel, wherein the scale is disposed in a scale sensitivity windscreen housing.

12. The device of claim 7, wherein the cabinet includes an opening in the hinged cover for proving unrestricted access to the receptacle.

13. A system for blending and dispensing liquid *cannabis*, comprising:

a carousel holding a plurality of syringe cartridges, wherein the plurality of syringe cartridges each contain a liquid;

a carousel drive assembly;

a plurality of constant pressure spring activated plunger assemblies associated with the plurality of syringe cartridges for selectively dispensing liquid from the plurality of syringe cartridges, wherein each of the plurality of syringe cartridges is mounted below one of the plurality of constant pressure spring activate plunger assemblies;

a receptacle for receiving the dispensed liquid from the plurality of syringe cartridges;

a CPU for controlling the dispensing of liquid from the plurality of syringe cartridges; and software for determining a formula for blending a quantity of liquid dispensed from one or more of the plurality of syringe cartridges.

14. The system of claim 13, wherein the formula includes a mix ratio, a potency, an ingredient profile and matter type.

15. The system of claim 14, further comprising a QR code reader, and wherein the software converts the formula into a QR code.

16. The system of claim 14, wherein the formula is created from a scalable selection of effect filters from a list of at least one of desired moods and symptoms to relieve.

17. A method for blending and dispensing liquid *cannabis*, comprising the steps of:

holding a plurality of syringe cartridges in a carousel, wherein the plurality of syringe cartridges each contain a liquid;

determining a formula for blending a quantity of liquid dispensed from one or more of the plurality of syringe cartridges via software;

selectively dispensing liquid from at least one of the plurality of syringe cartridges via a constant pressure spring activated plunger assembly associated with each of the plurality of syringe cartridges;

controlling the dispensing of liquid from at least one of the plurality of syringe cartridges according to the formula; and receiving the dispensed liquid from at least one of the plurality of syringe cartridges in a receptacle.

18. The method of claim 17, further comprising the step of creating a formula including a mix ratio, a potency, an ingredient profile and matter type.

19. The method of claim 18, further comprising the steps of converting the formula into a QR code, providing the QR code to an end user as a personal formula prescription for reuse, and reading the formula from the QR code.

20. The method of claim 18, further comprising the step of creating the formula from a scalable selection of effect filters from a list of at least one of desired moods and symptoms to relieve.

* * * * *